US009117380B2

(12) United States Patent
Walters et al.

(10) Patent No.: US 9,117,380 B2
(45) Date of Patent: Aug. 25, 2015

(54) BOLLARD ADVERTISING ASSEMBLY

(71) Applicants: Jacob Walters, Sioux Falls, SD (US); Thomas Charles Walters, Eden Prairie, MN (US)

(72) Inventors: Jacob Walters, Sioux Falls, SD (US); Thomas Charles Walters, Eden Prairie, MN (US)

(73) Assignee: JTE L.L.C., Eden Prairie, MN (US)

( * ) Notice: Subject to any disclaimer, the term of this patent is extended or adjusted under 35 U.S.C. 154(b) by 0 days.

(21) Appl. No.: 14/478,293

(22) Filed: Sep. 5, 2014

(65) Prior Publication Data

US 2015/0068084 A1 Mar. 12, 2015

Related U.S. Application Data

(60) Provisional application No. 61/874,379, filed on Sep. 6, 2013.

(51) Int. Cl.

| | |
|---|---|
| ***G09F 15/00*** | (2006.01) |
| ***G09F 23/00*** | (2006.01) |
| *G09F 7/18* | (2006.01) |

(52) U.S. Cl.

CPC ..... *G09F 23/00* (2013.01); *G09F 15/0075* (2013.01); *G09F 7/18* (2013.01); *G09F 2007/1878* (2013.01)

(58) Field of Classification Search

CPC ..... G09F 7/18; G09F 15/0075
USPC ..... 40/607.03, 612; 52/834
See application file for complete search history.

(56) References Cited

U.S. PATENT DOCUMENTS

| | | | | |
|---|---|---|---|---|
| 3,196,495 | A * | 7/1965 | Owen | 49/400 |
| 3,716,288 | A * | 2/1973 | Kannenberg | 359/552 |
| 5,116,204 | A | 5/1992 | Power et al. | |
| 5,299,883 | A * | 4/1994 | Arth, Jr. | 404/10 |
| 5,323,583 | A | 6/1994 | Venegas, Jr. | |
| 5,487,618 | A | 1/1996 | Cox | |
| 5,605,414 | A | 2/1997 | Fuller et al. | |
| 5,956,875 | A | 9/1999 | Aughenbaugh | |
| 6,061,939 | A | 5/2000 | Gildea | |
| 6,209,276 | B1 | 4/2001 | Venegas, Jr. | |
| D465,585 | S | 11/2002 | Venegas, Jr. | |
| 6,692,182 | B1 | 2/2004 | Fenimore | |
| 6,718,672 | B1 * | 4/2004 | Wieringa | 40/612 |
| 6,779,287 | B2 * | 8/2004 | Venegas, Jr. | 40/607.01 |
| 6,898,884 | B1 * | 5/2005 | Meyenberg | 40/649 |
| 6,971,198 | B2 | 12/2005 | Venegas, Jr. | |
| 7,150,117 | B2 | 12/2006 | Venegas, Jr. | |
| 7,351,003 | B1 | 4/2008 | Fenimore et al. | |
| 8,413,360 | B2 | 4/2013 | Walters | |
| 2002/0056251 | A1 | 5/2002 | Venegas, Jr. | |
| 2004/0060257 | A1 * | 4/2004 | Venegas | 52/736.3 |
| 2004/0226206 | A1 * | 11/2004 | Park et al. | 40/651 |
| 2005/0076586 | A1 | 4/2005 | Venegas, Jr. et al. | |
| 2006/0010823 | A1 * | 1/2006 | Waters et al. | 52/738.1 |
| 2006/0075666 | A1 | 4/2006 | Thielemans et al. | |
| 2006/0113515 | A1 * | 6/2006 | Venegas | 256/1 |
| 2006/0185998 | A1 | 8/2006 | McGrail et al. | |

(Continued)

*Primary Examiner* — Gary Hoge
(74) *Attorney, Agent, or Firm* — Merchant & Gould P.C.

(57) ABSTRACT

An advertising bollard assembly, comprising: a main body defining an interior and an outer surface; one or more compressible inserts positioned in the interior of the main body, the compressible inserts being configured to be positioned on a bollard to couple the advertising bollard assembly to the bollard; and an attachment mechanism coupled to the outer surface of the main body, the attachment mechanism being configured to receive one or more advertisements.

12 Claims, 16 Drawing Sheets

(56) References Cited

U.S. PATENT DOCUMENTS

| | | | | |
|---|---|---|---|---|
| 2006/0213530 | A1 | 9/2006 | Venegas, Jr. | |
| 2007/0104536 | A1* | 5/2007 | Raymond | 404/8 |
| 2007/0278466 | A1* | 12/2007 | Venegas | 256/1 |
| 2008/0263925 | A1 | 10/2008 | Berg | |
| 2009/0039328 | A1* | 2/2009 | Davidson | 256/66 |
| 2009/0178316 | A1* | 7/2009 | Parenti et al. | 40/564 |
| 2009/0255841 | A1 | 10/2009 | Sanches et al. | |
| 2009/0320396 | A1* | 12/2009 | Knudsen | 52/297 |
| 2011/0107635 | A1* | 5/2011 | Walters | 40/612 |
| 2012/0090207 | A1* | 4/2012 | Johnston | 40/606.01 |
| 2014/0053441 | A1* | 2/2014 | Arons et al. | 40/606.03 |

* cited by examiner

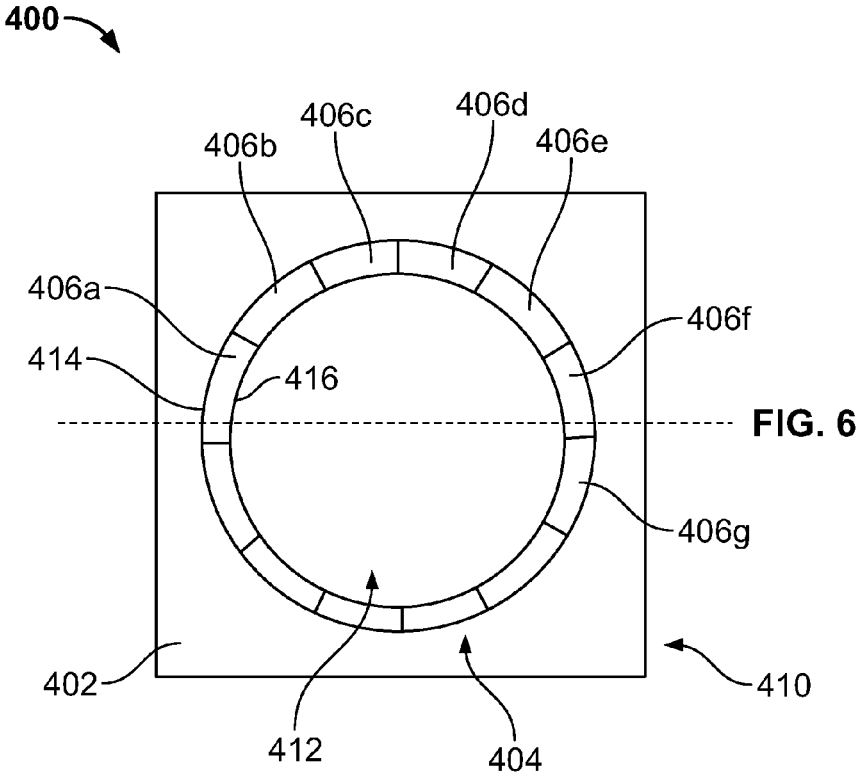
FIG. 6
FIG. 5
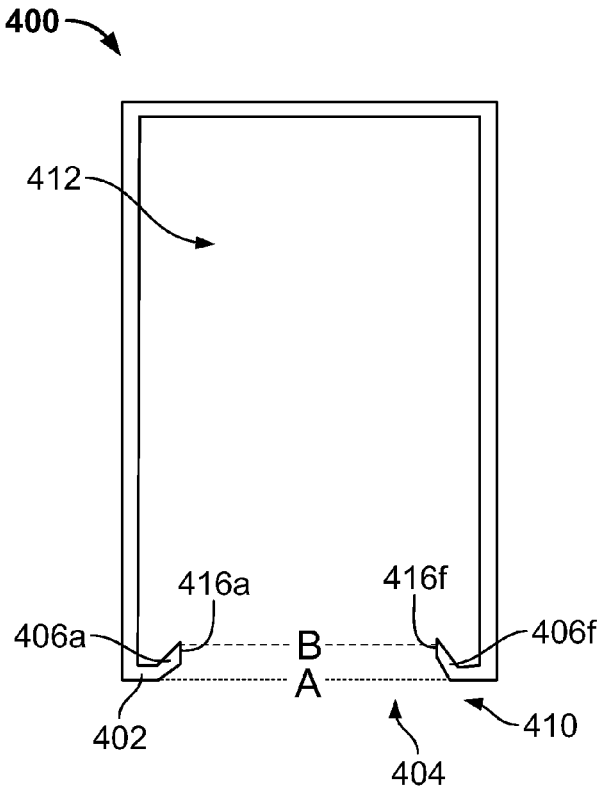
FIG. 6

BOLLARD ADVERTISING ASSEMBLY

RELATED APPLICATION

This patent application is related to U.S. Pat. No. 8,413,360 filed on Nov. 12, 2010, the entirety of which is hereby incorporated by reference.

This application claims the benefit of U.S. Patent Application Ser. No. 61/874,379 filed on Sep. 6, 2013, the entirety of which is hereby incorporated by reference.

BACKGROUND

Bollards are typically set in place to obstruct passage of pedestrian and vehicle traffic. As such, they are continuously subjected to various surface and structural damaging phenomena, including weathering, pollution, vandalism, physical contact, and others. In many instances, these phenomena reduce the service lifetime of a bollard.

SUMMARY

Assemblies for removably coupling advertisements to a bollard structure are disclosed. Multiple structures for securing the assemblies to the bollard structure are disclosed. Multiple structures for securing advertising indicia to the assemblies are disclosed. Assemblies for removably coupling advertising indicia to multiple bollard structures are disclosed.

DESCRIPTION OF THE DRAWINGS

Aspects of the disclosure may be more completely understood in consideration of the following detailed description of various embodiments of the disclosure in connection with the accompanying drawings, wherein:

FIG. 5 is a view of the coupling end of an example bollard advertising assembly.

FIG. 6 is a side cross-sectional view of the bollard advertising assembly of FIG. 5.

DETAILED DESCRIPTION

The example embodiments described in the following disclosure are provided by way of illustration only and should not be construed as limiting. Various modifications and changes may be made to the example embodiments described below without departing from the true spirit and scope of the disclosure.

The present disclosure relates generally to a bollard advertising assembly. More specifically, the present disclosure relates to an updatable bollard advertising assembly, in which the advertising indicia of a bollard advertising assembly may be quickly changed without significant modification to the assembly. In addition, the advertising indicia increase the visibility of the bollard structure to reduce inadvertent collisions with the bollard structure.

In the following example embodiments, the bollard advertising assembly is constructed to: a) include one or more advertising attachment mechanisms to increase the visibility of the bollard structure and convey messages; and b) in some cases, protect objects coming in contact with the bollard structure from damage incurred from various surface and structural degrading phenomena. Although the present disclosure is not so limited, an appreciation of the various aspects of the disclosure will be gained through a discussion of the examples provided below.

Figure 1:
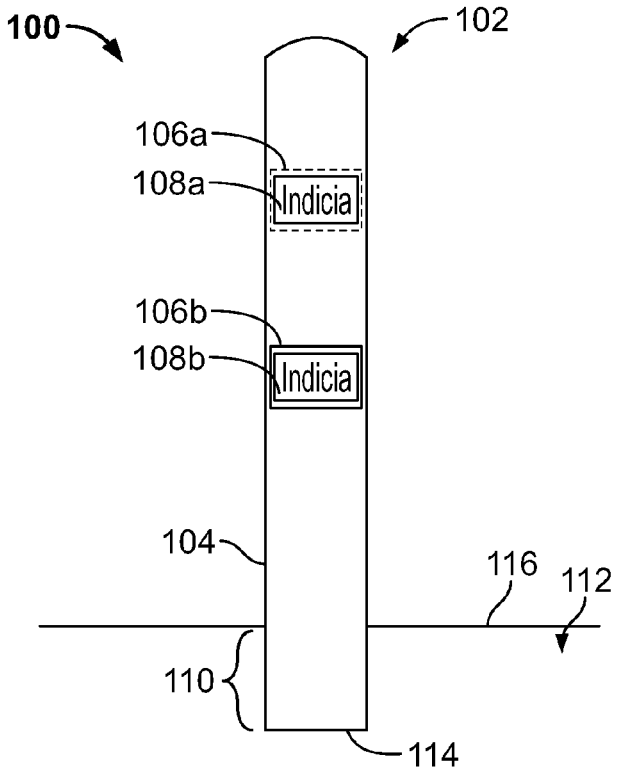
FIG. 1 is a side view of an example bollard advertising assembly.

Referring now to FIG. 1, an example bollard advertising assembly 100 is shown. In general, the assembly 100 includes a bollard structure 102 and one or more advertising attachment mechanisms 106*a-b* (collectively, advertising attachment mechanisms 106).

The bollard structure 102 generally includes at least a securing portion 110 and an external surface 104. The securing portion 110 is positioned within a securing body 112 to secure the bollard structure 102 in a fixed position. However, it will be appreciated that the bollard structure 102 may include one or more portions that are positioned within the securing body 112, depending on the shape and the functional purpose of the bollard structure 102. In some examples, the securing body 112 is the ground or a paved/concrete surface.

The bollard structure 102 can be secured to the securing body 112 via any of a plurality of methods. As depicted, the securing portion 110 of the bollard structure 102 is positioned within the securing body 112. Alternatively, the bollard structure 102 can be secured to the securing body 112 by coupling a first end 114 of the bollard structure 102 to a top surface 116 of the securing body 112. Additionally, the bollard structure 102 can be permanently or temporarily secured to securing body 112 or simply disposed on securing body 112 without additional securing mechanisms. Other methods for securing the bollard structure 102 to the securing body 112 are possible as well.

In example embodiments, the bollard structure 102 can be characterized as any type of pole, post, column, pillar, or other structure that is used to provide access control and various other functions. In some embodiments, bollard structure 102 is used to prevent vehicle collisions with expensive, volatile, or dangerous equipment, such as a fuel pump. Additionally, the bollard structure 102 can include features to serve as a security bollard, a pedestrian bollard, a traffic bollard, a retractable/rising bollard, a folding bollard, a landscape/architectural bollard, a mooring bollard, a bicycle rack bollard, and any other type of unlisted or otherwise specialized bollard. In this regard, it will be appreciated that the bollard structure 102 can generally be any desired shape, size, comprise of any material or compound, include any type of finish, and include any aesthetic and/or otherwise functional features. Additionally, the bollard structure 102 can be installed individually to a securing body 112 or as part of a larger system comprising a plurality of bollard structures 102.

In some embodiments, the external surface 104 of the bollard structure 102 is visible from the area proximate the bollard structure 102. Generally, the external surface 104 can be smooth or rough, finished or unfinished, painted or unpainted, or it may have any other surface characteristic.

For example, in one embodiment, the external surface 104 of the bollard structure 102 includes one or more advertising attachment mechanisms 106 positioned thereon. In general, the advertising attachment mechanisms 106 can be located at any site on the external surface 104. Additionally, the advertising attachment mechanisms 106 can be positioned in any orientation on the external surface 104. In some embodiments, the advertising attachment mechanisms 106 are configured to couple advertising indicia 108*a-b* (collectively, advertising indicia 108) to the bollard structure 102. In some embodiments, the advertising attachment mechanisms 106 are configured to removably couple advertising indicia 108 to the bollard structure 102.

Generally, the advertising attachment mechanism 106 includes any mechanism for coupling the advertising indicia 108 to the bollard structure 102. Generally, the advertising attachment mechanisms 106 are designed to readily couple, decouple, and replace advertising indicia 108 in the advertising attachment mechanisms 106. For example, in some embodiments the advertising attachment mechanisms 106 are a plurality of J-hooks configured to couple to the sides of the advertising indicia 108. In other possible embodiments, the advertising attachment mechanisms 106 are hooks, snaps, clips, ledges, buttons, slots, channels, sleeves, magnets, pockets, and various combinations thereof. Still other embodiments are possible. These advertising attachment mechanisms 106 may be built into the bollard structure at the time it is constructed thereby permitting advertising indicia to be coupled to the bollard structure as deemed appropriate by the owner of the bollard structure.

In example embodiments, the advertising indicia 108 includes a message that can be, for example, any type of visual, audio, video, or otherwise perceivable message. For example, the advertising indicia 108 can include a message comprising an image, such as lettering, graphics, and the like that generally can be electronically generated and/or formed from materials such as synthetics (e.g., plastics, paint, composites, and others) and non-synthetics (e.g., wood, bio-polymer, and other organic materials). In some embodiments, the advertising indicia 108 may be controlled by a central network that controls advertising on one or more assemblies. Accordingly, the assembly 100 may house electronic components, such as computers, network cards, display panels, and power sources. In some embodiments, the power source is a battery, a solar panel, an external power source, or any combination thereof.

Additionally, the advertising indicia 108 can include a message that has an audio or visual component, such as a sound or light that indicates the presence of the bollard structure 102 upon a moving structure entering within a predetermined distance of the bollard structure 102. In this regard, it will be appreciated that the advertising indicia 108 can include any message having characteristics (e.g., size, color, tone) that has an influence on the visibility of the advertising indicia 108, in turn increasing the visibility of the bollard structure 102 and attention to the advertising indicia 108.

Additionally, in some embodiments, the advertising indicia 108 include a coupon to provide a discount on the purchase of a product. In some embodiments, the coupon is a physical coupon that is printed on-demand by the assembly 100 or pre-printed and disposed in a pocket or otherwise on assembly 100. In other embodiments, the coupon is a digital coupon, which may be accessed through a quick response code (QR code), bar code, uniform resource locator, or code provided on the advertising indicia 108.

In one aspect, the advertising attachment mechanisms 106 are integrally formed with the external surface 104. In another aspect, the advertising attachment mechanisms 106 comprise of a separate structure from the external surface 104. For example, embedded advertising attachment mechanism 106*a* is integrally formed with the external surface 104. Embedded attachment mechanism 106*a* is depicted in FIG. 1 as an intermittent line pattern.

As another example, advertising attachment mechanism 106*b* is a structure that is separate from the external surface 104. The separate structure is then coupled to the external surface 104. An example of the separate advertising attachment mechanism 106*b* is depicted in FIG. 1 as a solid line pattern. In certain embodiments, separate advertising attachment mechanism 106*b* is removably coupled to the external surface 104. For example, in some embodiments, advertising attachment mechanism 106*b* is coupled to external surface 104 with straps, bolts, compression force, zip ties, rubber bands, elastic bands, screw/band clamps, adhesive, or any other mechanism. In other embodiments, separate advertising attachment mechanism 106*b* is permanently coupled to the external surface 104 after construction of external surface 104.

Although the example embodiment of bollard advertising assembly 100 shown in FIG. 1 includes two advertising attachment mechanisms 106, other embodiments with more or fewer advertising attachment mechanisms are possible.

Figure 2:
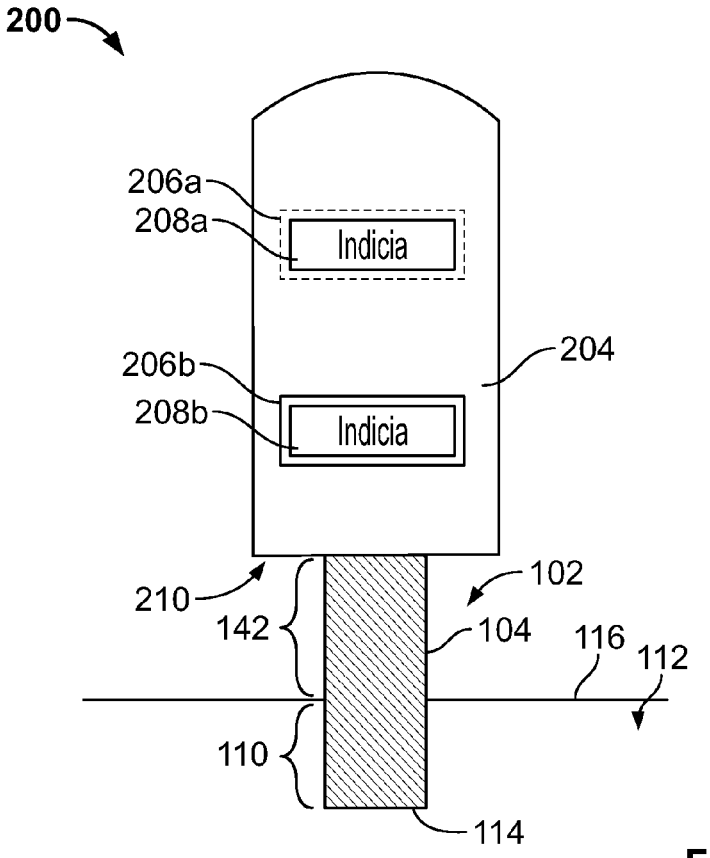
FIG. 2 is an example bollard advertising assembly coupled to a bollard structure.

Referring now to FIG. 2, an example embodiment of a bollard advertising assembly 200 coupled to a bollard structure 102 is shown. In example embodiments, the bollard structure 102 is a cylindrical structure. As mentioned above, other embodiments of the bollard structure 102 are possible as well, such as triangles, squares, ovals, and other shapes. Additionally, in some embodiments the bollard structure 102 has an enclosed top. In yet other embodiments, the bollard structure 102 has an open top.

In some embodiments, the assembly 200 is a flexible U-shaped assembly or flat top assembly that includes an external surface 204 and one or more advertising attachment mechanisms 206*a-b* (collectively, advertising attachment mechanisms 206). The assembly 200 is configured to couple to the bollard structure 102. In some embodiments, the assembly 200 additionally includes an open coupling end 210 adjacent to a cavity. See, for example, the image of the open coupling end and the cavity of an example embodiment shown in FIGS. 21-22. Other embodiments of the assembly 200 are possible as well. For example, in one embodiment, the assembly 200 can be a tube-shaped assembly having two open ends adjacent to an inner passage. In yet other embodiments, the assembly 200 can be rectangular. In some embodiments, the assembly 200 is formed from a rigid or semi-rigid material. In some embodiments, the assembly 200 comprises a single layer; in other embodiments the assembly 200 comprises more than one layer.

Although the bollard structure 102 is depicted in FIG. 2 as being partially covered by the assembly 200, it will be appreciated that the assembly 200 can be manufactured such that a length 142 that characterizes an exposed length of the bollard structure 102 can be selected as desired. In example embodiments, approximately ¼ of the bollard structure 102 that is not positioned within the securing body 112 is covered by the assembly 200. However, in certain embodiments, it may be desired that the length 142 approaches zero such that the portion of the bollard structure 102 that is not positioned within the securing body 112 is fully covered by the assembly 200.

For example, in one embodiment, the external surface 204 of the assembly 200 includes one or more advertising attachment mechanisms 206 positioned thereon. In general, the advertising attachment mechanisms 206 can be located at any site on the external surface 204. Additionally, the advertising attachment mechanisms 206 can be positioned in any orientation on the external surface 204. In some embodiments, the advertising attachment mechanisms 206 are configured to couple advertising indicia 208*a-b* (collectively, advertising indicia 208) to the assembly 200. In some embodiments, the advertising attachment mechanisms 206 are configured to removably couple advertising indicia 208 to the assembly 200.

Generally, the advertising attachment mechanisms 206 include any mechanism for coupling the advertising indicia 208 to the assembly 200. For example, in some embodiments the advertising attachment mechanisms 206 are a plurality of J-hooks configured to couple to the sides of the advertising indicia 208. In other possible embodiments, the advertising attachment mechanisms 206 are hooks, snaps, clips, ledges, buttons, slots, channels, sleeves, magnets, pockets, tension devices (e.g., rubber bands), clamps, bolts, adhesives, and various combinations thereof. In some embodiments, the advertising attachment mechanisms 206 are held in place by tension devices (e.g., rubber bands), clamps, bolts, adhesives, and various combinations thereof. Still other embodiments are possible.

In example embodiments, the advertising indicia 208 includes a message that can be, for example, any type of visual, audio, video, or otherwise perceivable message. For example, the advertising indicia 208 can include a message comprising an image, such as lettering, graphics, and the like that generally can be electronically generated and/or formed from materials such as synthetics (e.g., plastics, paint, composites, and others) and non-synthetics (e.g., wood, bio-polymer, and other organic materials). In some embodiments, the advertising indicia 208 may be controlled by a central network that controls advertising on one or more assemblies. Accordingly, the assembly 200 may house electronic components, such as computers, network cards, display panels, and power sources. In some embodiments, the power source is a battery, a solar panel, an external power source, or any combination thereof.

Additionally, the advertising indicia 208 can include a message that has an audio or visual component, such as a sound or light that indicates the presence of the assembly 200 and bollard structure 102 upon a moving structure entering within a predetermined distance of the bollard structure 102. In this regard, it will be appreciated that the advertising indicia 208 can include any message having characteristics (e.g., size, color, tone) that has an influence on the visibility of the advertising indicia 108, in turn increasing the visibility of the bollard structure 102 and attention to the advertising indicia 108.

In one aspect, the advertising attachment mechanisms 206 are integrally formed with the external surface 204. In another aspect, the advertising attachment mechanisms 206 comprise a separate structure from the external surface 204. For example, embedded advertising attachment mechanism 206*a* is integrally formed with the external surface 204. Embedded attachment mechanism 206*a* is depicted in FIG. 2 as an intermittent line pattern.

As another example, advertising attachment mechanism 206*b* is a structure that is separate from the external surface 204. The separate structure is then coupled to the external surface 204. An example of the separate advertising attachment mechanism 206*b* is depicted in FIG. 2 as a solid line pattern. In certain embodiments, separate advertising attachment mechanisms 206*b* are removably coupled to the external surface 204. In other embodiments, separate advertising attachment mechanisms 206*b* are permanently coupled to the external surface 204.

Although the example embodiment of assembly 200 shown in FIG. 2 includes two advertising attachment mechanisms 206, other embodiments with more or fewer advertising attachment mechanisms are possible.

In some embodiments, one or more layers of the assembly 200 are formed from an insulating, shock absorbing material. In general, the shock absorbing material is deformable under application of force, and includes hysteresis properties such that when the applied force is removed, the material reverts to an unloaded shape.

Accordingly, in the event of an incident impact (e.g., by a car bumper or car door) upon the assembly 200 (and when the assembly 200 is coupled to the bollard structure 102), the assembly 200 absorbs the impact and provides some protection to the bollard structure 102 and the impacting entity. Further, in some embodiments, when the impact incident has passed, the assembly 200 will revert to its initial shape or approximate initial shape depending on the degree of damage from the impact.

In example embodiments, the assembly 200 is removably coupled to the bollard structure 102 by coincidently aligning the bollard structure 102 with the coupling end 210 of the assembly 200. Subsequently, the assembly 200 is moved in a direction parallel to the bollard structure 102 such that the bollard structure 102 enters into the cavity of the assembly 200. When positioned together, the surface 104 of the bollard structure 102 is in contact with an interior surface of the assembly 200.

Figure 3:
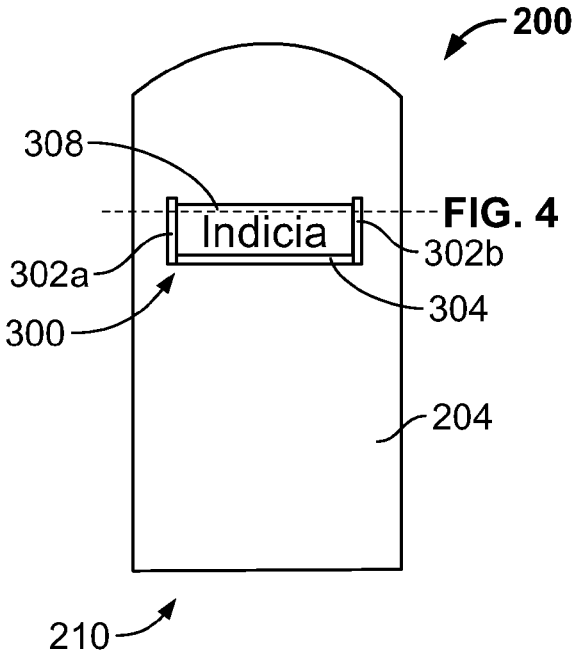
FIG. 3 is an example advertising attachment mechanism of the assembly of FIG. 2.

Referring now to FIG. 3, an example advertising attachment mechanism 300 is shown for coupling advertising indicia 308 to bollard advertising assembly 200.

In some embodiments, the advertising attachment mechanism 300 comprises a plurality of J-hooks 302*a-b* (collectively, J-hooks 302) and a horizontal support mechanism 304. Together, the J-hooks 302 and horizontal support mechanism 304 are configured to secure advertising indicia 308 to assembly 200.

Figure 4:
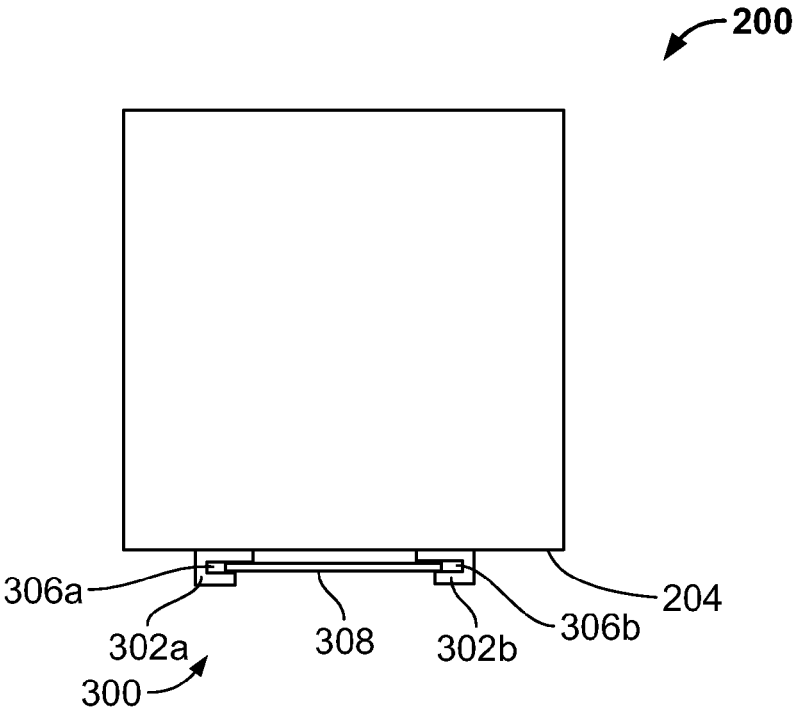
FIG. 4 is an example advertising attachment mechanism of the assembly of FIG. 2.

In some embodiments, J-hooks 302 are configured to secure advertising indicia 308 in the channel formed between the edges of the J-hooks. Accordingly, advertising indicia 308 may be slid into J-hooks 302 (this is best illustrated in FIG. 4). In some embodiments, horizontal support mechanism 304 is a shelf or ledge disposed below J-hooks 302. In this manner, horizontal support mechanism 304 prevents advertising indicia 308 from sliding all of the way through J-hooks 302. In other embodiments, horizontal support mechanism 304 is also a J-hook. Still other embodiments are possible.

Referring now to FIG. 4, the example advertising attachment mechanism 300 for coupling advertising indicia 308 to bollard advertising assembly 200 is shown in cross-section. Although assembly 200 has a rectangular shape in FIG. 4, other embodiments having other shapes, such as round, oval, triangular, and others are possible.

In some embodiments, J-hooks 302 are configured in the shape of the letter J. The long arms of the J-hooks 302 are secured to external surface 204. The short arms of the J-hooks 302 are disposed approximately parallel to external surface 204. In some embodiments, the open space between the arms of the J-hooks 302 forms channels 306*a-b* (collectively, channels 306).

Advertising indicia 308 is disposed in the channels formed between the edges of J-hooks 302. In some embodiments, the short arms of the J-hooks are flexible and biased towards the long arms so as to pinch and hold advertising indicia 308 in place. In other embodiments, the arms of the J-hooks are rigid and advertising indicia 308 is held in place through a different mechanism, such as by being disposed upon a horizontal support mechanism or by the rigidity of the advertising indicia 308. Still other embodiments are possible.

Although the embodiment of assembly 200 shown in FIG. 4 includes only one advertising attachment mechanism 300, other embodiments that include multiple advertising attachment mechanisms are possible. In some embodiments, multiple advertising attachment mechanisms are disposed on a single face of the assembly 200. In other embodiments, advertising attachment mechanisms are disposed on a plurality of sides of the assembly 200. In yet other embodiments, multiple advertising attachment mechanisms are disposed on each side of the assembly 200. In some example embodiments, a single advertising attachment mechanism is disposed across more than one side of the assembly 200 so that the advertising indicia wraps around the assembly 200. Still other embodiments are possible.

Referring now to FIG. 5, the coupling end 410 of an example bollard advertising assembly 400 is shown. Although assembly 400 has a rectangular shape in FIG. 5, other embodiments having other shapes, such as round, oval, triangular, and others are possible.

The coupling end 410 is configured to couple to a bollard structure. In some embodiments, the coupling end includes a bottom surface 402, an aperture 404, and a plurality of tabs 406. For example, in FIG. 5, tabs 406*a-g* are labeled. Additional tabs are shown but are not labeled.

The aperture 404 is formed in bottom surface 402. The aperture 404 is adjacent to cavity 412 and is configured to permit a bollard structure to enter cavity 412. In some embodiments, the aperture 404 is sized to snugly fit over a bollard structure. In some embodiments, the aperture 404 is circular in shape. In other embodiments, the aperture 404 is oval in shape. In yet other embodiments, the aperture 404 is rectangular in shape. In some embodiments, the aperture 404 comprises a separate surface that is disposed near the bottom surface 402. Still other embodiments are possible.

Tabs 406 include outer edges 414 and inner edges 416. Outer edges 414 are flexibly secured to bottom surface 402 at the edge of aperture 404. Inner edges 416 are disposed inside the aperture 404 and are not secured to another surface. In this manner, the tabs 406 line the edge of aperture 404. In some embodiments, the tabs 406 are adjacent to but are not secured to each other.

The inner edges 416 of tabs 406 at opposite positions along the circumference of aperture 404 (for example tabs 406*a* and 406*g*) are disposed at a distance that is less than the diameter of aperture 404. In some embodiments, the distance between the inner edges of tabs 406 at opposite positions along the circumference of aperture 404 is less than the corresponding dimension of the bollard structure. In some embodiments, tabs 406 are biased towards cavity 412 (this is best seen in FIG. 6).

Referring now to FIG. 6, a cross-section view of the example bollard advertising assembly 400 is shown.

As described above, tabs 406 line the edge of aperture 404 and are biased towards cavity 412. In some embodiments, the width of aperture 404 (shown in FIG. 6 as a dashed line labeled A) is configured to securely fit over a bollard structure. Conversely, the distance between the inner edges of opposing tabs (shown in FIG. 6 as a dashed line labeled B) is configured to be less than the corresponding dimension of a bollard structure.

Figure 7:
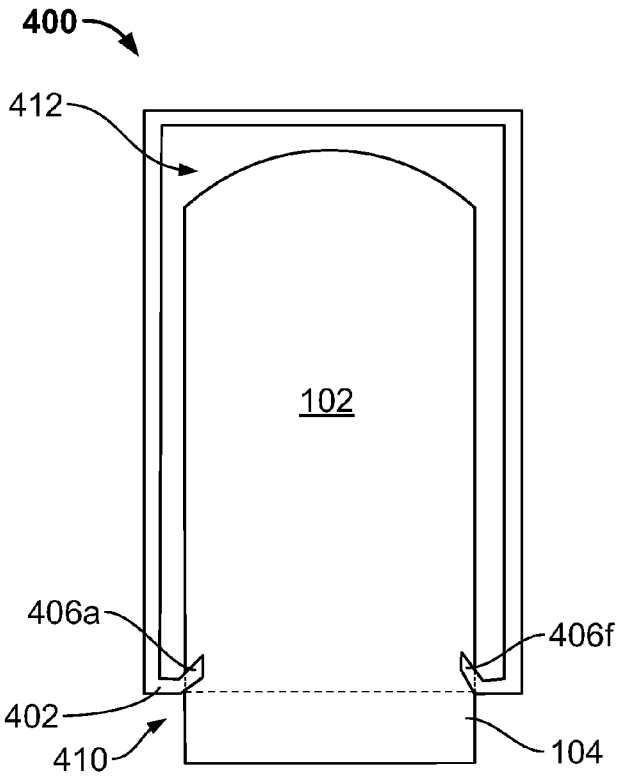
FIG. 7 is a side cross-sectional view of the bollard advertising assembly of FIG. 5 coupled to a bollard structure.

Referring now to FIG. 7, a cross-section view of the example bollard advertising assembly 400 coupled to bollard structure 102 is shown.

In some embodiments, tabs 406 are configured to flex into cavity 412 when assembly 400 is disposed on a bollard structure 102. Accordingly, the assembly can be placed on a bollard structure with a width greater than the distance between opposing tabs 406. In some embodiments, the inner edges 416 of tabs 406 have a rough surface that is configured to contact the external surface 104 of the bollard structure 102. In these embodiments, the rough surface of inner edges 416 of tabs 406 does not easily slide along the external surface 104 of the bollard structure 102. Additionally, in some embodiments, the tabs 406 are configured to resist flexing when the assembly 400 is being removed from the bollard structure 102. In this manner, the tabs 406 secure the assembly 400 to the bollard structure 102. In some embodiments, one or more additional apertures lined with tabs are disposed within the cavity 412 to further secure the assembly 400 to the bollard structure 102. In these embodiments, the additional apertures may be coupled to an interior surface of the assembly 400 at or above coupling end 410. These additional apertures may increase the rigidity of the assembly 400 and improve the impact resistance and protective properties of the assembly 400 to both the bollard structure 102 and the entity impacting the assembly 400.

Figure 8:
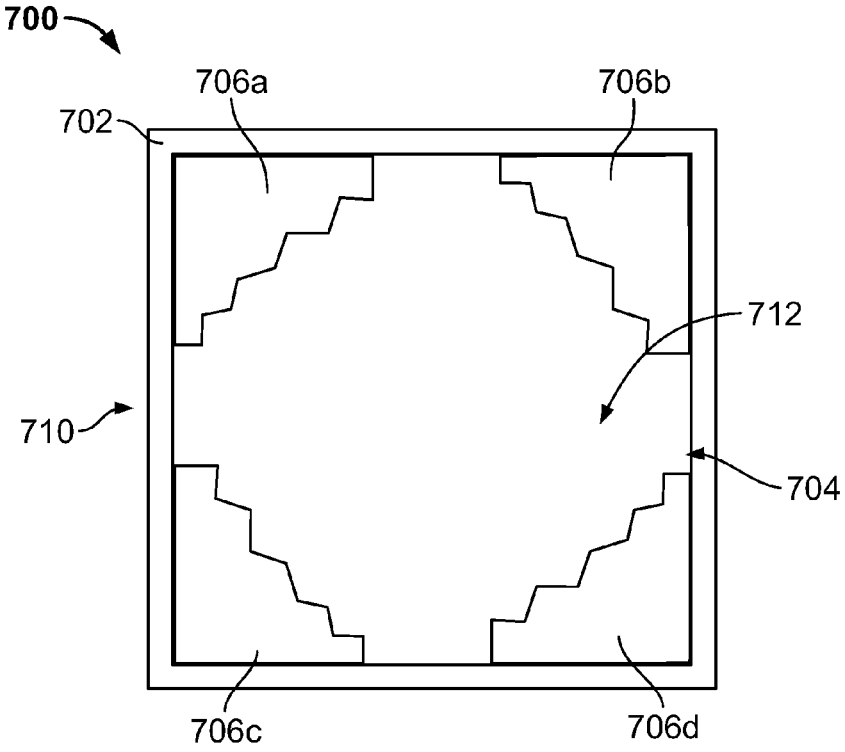
FIG. 8 is a view of the coupling end of another example bollard advertising assembly.

Referring now to FIG. 8, the coupling end 710 of an example bollard advertising assembly 700 is shown. Although assembly 700 has a rectangular shape in FIG. 8, other embodiments having other shapes, such as round, oval, triangular, and others are possible.

The coupling end 710 of assembly 700 includes a bottom surface 702, an aperture 704, and one or more compressible inserts 706*a-d* (collectively, compressible inserts 706).

The aperture 704 is formed in the bottom surface 702. The aperture 704 is adjacent to cavity 712 and is configured to permit a bollard structure to enter cavity 712. In some embodiments, the aperture 704 is sized to snugly fit over a bollard structure. In some embodiments, the aperture 704 is circular in shape. In other embodiments, the aperture 704 is oval in shape. In yet other embodiments, the aperture 704 is rectangular in shape. Still other embodiments are possible.

In general, the compressible inserts 706 are made from a compressible material that is deformable under application of force and includes hysteresis properties such that when the applied force is removed, the material reverts to an unloaded shape. In some embodiments, the compressible inserts 706 are made from polystyrene foam or rubber. Still other embodiments are possible.

The compressible inserts 706 are configured to fit inside of aperture 704. The compressible inserts 706 are configured to have an unloaded shape that narrows the size of the aperture 704. In some embodiments, the unloaded shape of the compressible inserts 706 narrows the size of the aperture 704 so that it is smaller than the bollard structure. When the assembly 700 is placed on the bollard structure, the compressible inserts 706 are compressed between the edge of the aperture 704 and the external surface of the bollard structure. Under compression, the compressible inserts 706 exert an expansion force back against the edge of the aperture 704 and the exterior surface of the bollard structure. This expansion force couples the assembly 700 to the bollard structure.

In some embodiments, the compressible inserts 706 are integrally formed with assembly 700. In other embodiments, the compressible inserts 706 are permanently coupled or removably coupled to assembly 700. Yet in other embodiments, the compressible inserts are not coupled to assembly 700 at all. Still other embodiments are possible.

Further, in some embodiments, additional compressible inserts 706 may be disposed at various positions on the interior of the assembly 700 to further secure the assembly 700 to the bollard structure. In these embodiments, the additional compressible inserts 706 exert a force against an interior surface of the assembly 700 and an exterior surface of the bollard structure. This force further secures the assembly 700 to the bollard structure.

Although multiple compressible inserts 706 are shown in FIG. 8, some embodiments include only a single compressible insert. In some of these embodiments, the compressible insert may be round or ring-shaped.

Figure 9:
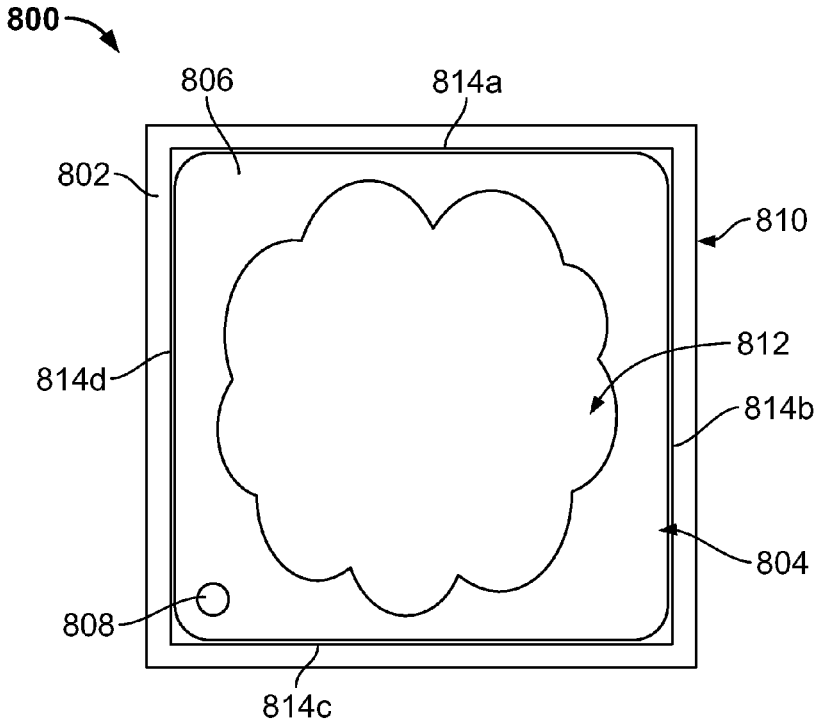
FIG. 9 is a view of the coupling end of another example bollard advertising assembly.

Referring now to FIG. 9, the coupling end 810 of an example bollard advertising assembly 800 is shown. Although assembly 800 has a rectangular shape in FIG. 9, other embodiments having other shapes, such as round, oval, triangular, and others are possible.

The coupling end 810 of assembly 800 includes a bottom surface 802, an aperture 804, an inflatable layer 806, and one or more interior surfaces 814*a-d* (collectively, interior surfaces 814).

The aperture 804 is formed in the bottom surface 802. The aperture 804 is adjacent to cavity 812 and is configured to permit a bollard structure to enter cavity 812. In some embodiments, the aperture 804 is sized to snugly fit over a bollard structure. In some embodiments, the aperture 804 is circular in shape. In other embodiments, the aperture 804 is oval in shape. In yet other embodiments, the aperture 804 is rectangular in shape. Still other embodiments are possible.

In general, the inflatable layer 806 is configured to contain a fluid substance and to expand as it is inflated with that fluid substance. Inflatable layer 806 includes at least one valve mechanism 808 through which fluid may be transferred into and out of the inflatable layer 806. In some embodiments, the inflatable layer 806 is a rubber bladder and the fluid substance is air. Other embodiments are possible however.

The inflatable layer 806 is configured to fit inside of aperture 804 and abut at least a portion of interior surfaces 814. In some embodiments, the inflatable layer 806 is inflated after the assembly is placed on a bollard structure. As the inflatable layer 806 inflates, it exerts pressure upon the exterior surface of the bollard structure and the aperture 804 or the interior surfaces 814 of the assembly 800. This pressure couples the assembly 800 to the bollard structure. In some embodiments, the inflatable layer 806 is partially inflated before the assembly is placed on a bollard structure.

In some embodiments, the inflatable layer 806 is permanently coupled or removably coupled to the interior surfaces 814. In other embodiments, the inflatable layer is not coupled to assembly 800 at all. Still other embodiments are possible.

Figure 10:
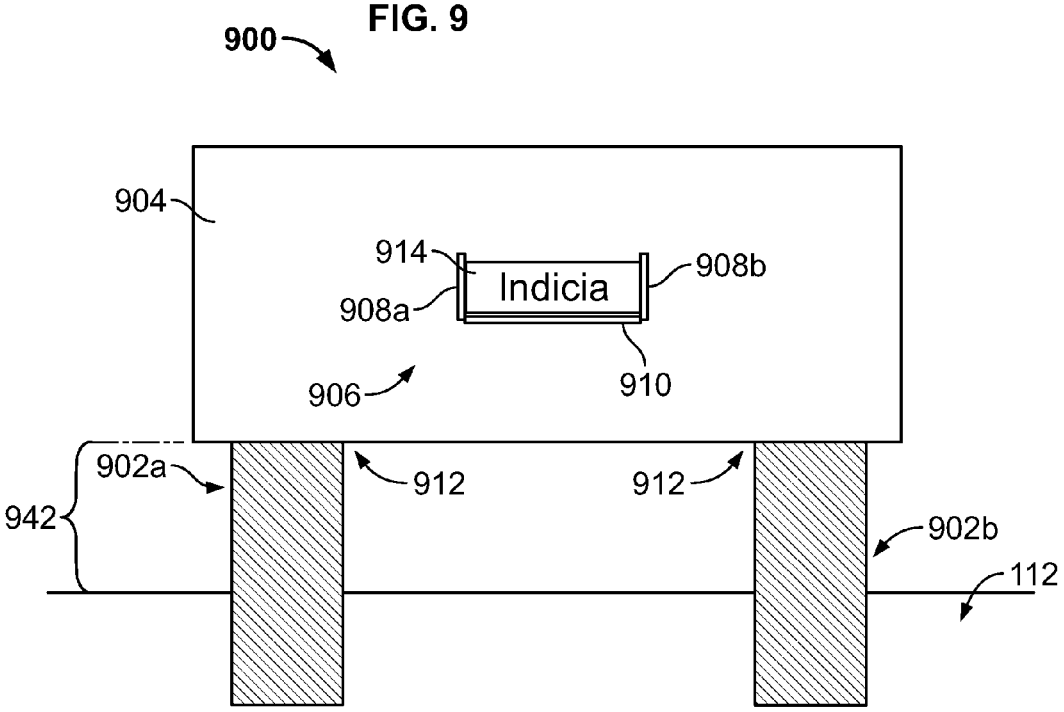
FIG. 10 is an example bollard advertising assembly coupled to multiple bollard structures.

Referring now to FIG. 10, an example bollard advertising assembly 900 is shown.

In some embodiments, the assembly 900 is a flexible rectangular assembly that includes an external surface 904 and one or more advertising attachment mechanisms 906. Although assembly 900 has a rectangular shape in FIG. 10, other embodiments having other shapes, such as round, oval, triangular, and others are possible. In some embodiments, assembly 900 has a curved or round top. Yet other embodiments are possible.

In some example embodiments, the assembly 900 is configured to couple to multiple bollard structures 902*a-b* (collectively, bollard structures 902) at a coupling end 912. In other embodiments, assembly 900 is configured to couple to a single upside down U-shaped bollard structure. Still other embodiments are possible.

The assembly 900 is configured to couple to the bollard structures 902 at a coupling end 912. In some embodiments, the coupling end 912 is open and adjacent to a cavity. Other embodiments of the assembly 900 are possible as well.

Although the bollard structures 902 are depicted in FIG. 10 as being partially covered by the assembly 900, it will be appreciated that the assembly 900 can be manufactured such that a length 942 that characterizes an exposed length of the bollard structures 902 can be selected as desired. In example embodiments, approximately ¼ of the bollard structures 902 that are not positioned within the securing body 112 are covered by the assembly 900. However, in certain embodiments, it may be desired that the length 942 approaches zero such that the portion of the bollard structures 902 that are not positioned within the securing body 112 are fully covered by the assembly 900.

For example, in one embodiment, the external surface 904 of the assembly 900 includes one or more advertising attachment mechanisms 906 positioned thereon. In general, the advertising attachment mechanisms 906 can be located at any site on the external surface 904. Additionally, the advertising attachment mechanisms 906 can be positioned in any orientation on the external surface 904. In some embodiments, the advertising attachment mechanism 906 is configured to couple advertising indicia 914 to the assembly 900. In some embodiments, the advertising attachment mechanism 906 is configured to removably couple advertising indicia 914 to the assembly 900.

Generally, the advertising attachment mechanism 906 includes any mechanism for coupling the advertising indicia 914 to the assembly 900. For example, in some embodiments the advertising attachment mechanism 906 is a plurality of J-hooks configured to secure the sides of the advertising indicia 914. In other possible embodiments, the advertising attachment mechanisms 906 are hooks, snaps, clips, ledges, buttons, slots, channels, sleeves, magnets, pockets, and various combinations thereof. Still other embodiments are possible.

In some embodiments, advertising attachment mechanism 906 comprises a plurality of J-hooks 908*a-b* (collectively, J-hooks 908) and a horizontal support mechanism 910. Together, the J-hooks 908 and horizontal support mechanism 910 are configured to secure advertising indicia 914 to assembly 900.

In some embodiments, J-hooks 908 are configured to secure advertising indicia 914 in the channel formed between the edges of the J-hooks. Accordingly, the advertising indicia 914 may be slid into J-hooks 908 (this is best illustrated in FIG. 4). In some embodiments, horizontal support mechanism 910 is a shelf or ledge disposed below J-hooks 908. In this manner, horizontal support mechanism 910 prevents advertising indicia 914 from sliding all of the way through J-hooks 908. In other embodiments, horizontal support mechanism 910 is also a J-hook. Still other embodiments are possible.

In example embodiments, the advertising indicia 914 includes a message that can be, for example, any type of visual, audio, video, or otherwise perceivable message. For example, the advertising indicia 914 can include a message comprising an image, such as lettering, graphics, and the like that generally can be electronically generated and/or formed from materials such as synthetics (e.g., plastics, paint, composites, and others) and non-synthetics (e.g., wood, bio-polymer, and other organic materials). In some embodiments, the advertising indicia 914 may be controlled by a central network that controls advertising on one or more assemblies. Accordingly, the assembly 900 may house electronic components, such as computers, network cards, display panels, and power sources. In some embodiments, the power source is a battery, a solar panel, an external power source, or any combination thereof.

Additionally, the advertising indicia 914 can include a message that has an audio or visual component, such as a sound or light that indicates the presence of the assembly 900 and bollard structures 902 upon a moving structure entering within a predetermined distance of the bollard structures 902 or assembly 900. In this regard, it will be appreciated that the advertising indicia 914 can include any message having characteristics (e.g., size, color, tone) that has an influence on the visibility of the advertising indicia 914, in turn increasing the visibility of the bollard structures 902 and attention to the advertising indicia 914.

In one aspect, the advertising attachment mechanisms 906 are integrally formed with the external surface 904. In another aspect, the advertising attachment mechanisms 906 comprise of a separate structure from the external surface 904.

Although the example embodiment of assembly 900 shown in FIG. 10 includes one advertising attachment mechanism 906, other embodiments with more or fewer advertising attachment mechanisms are possible.

In example embodiments, the assembly 900 is removably coupled to the bollard structures 902 by coincidently aligning the bollard structures 902 with the coupling end 912 of the assembly 900. Subsequently, the assembly 900 is moved in a direction parallel to the bollard structures 902 such that the bollard structures 902 enter into the cavity of the assembly 900. In some embodiments, assembly 900 is coupled to the bollard structures 902 with one or more apertures lined with tabs (see FIGS. 5-7). In other embodiments, assembly 900 is coupled to the bollard structures with one or more compressible inserts (see FIG. 8). In these embodiments, the compressible inserts may be disposed between the bollard structures 902 and the interior surfaces of assembly 900. In some of these embodiments, the compressible inserts are not disposed between the bollard structures 902. In some embodiments, assembly 900 is coupled to the bollard structures with one or more inflatable layers (see FIG. 9). Further, in some embodiments, assembly 900 includes one or more layers of impact absorbing material (e.g., foam) to protect the bollard structures 902 and the entity impacting the bollard structures 902 from damage. Still other embodiments are possible.

Figure 11:
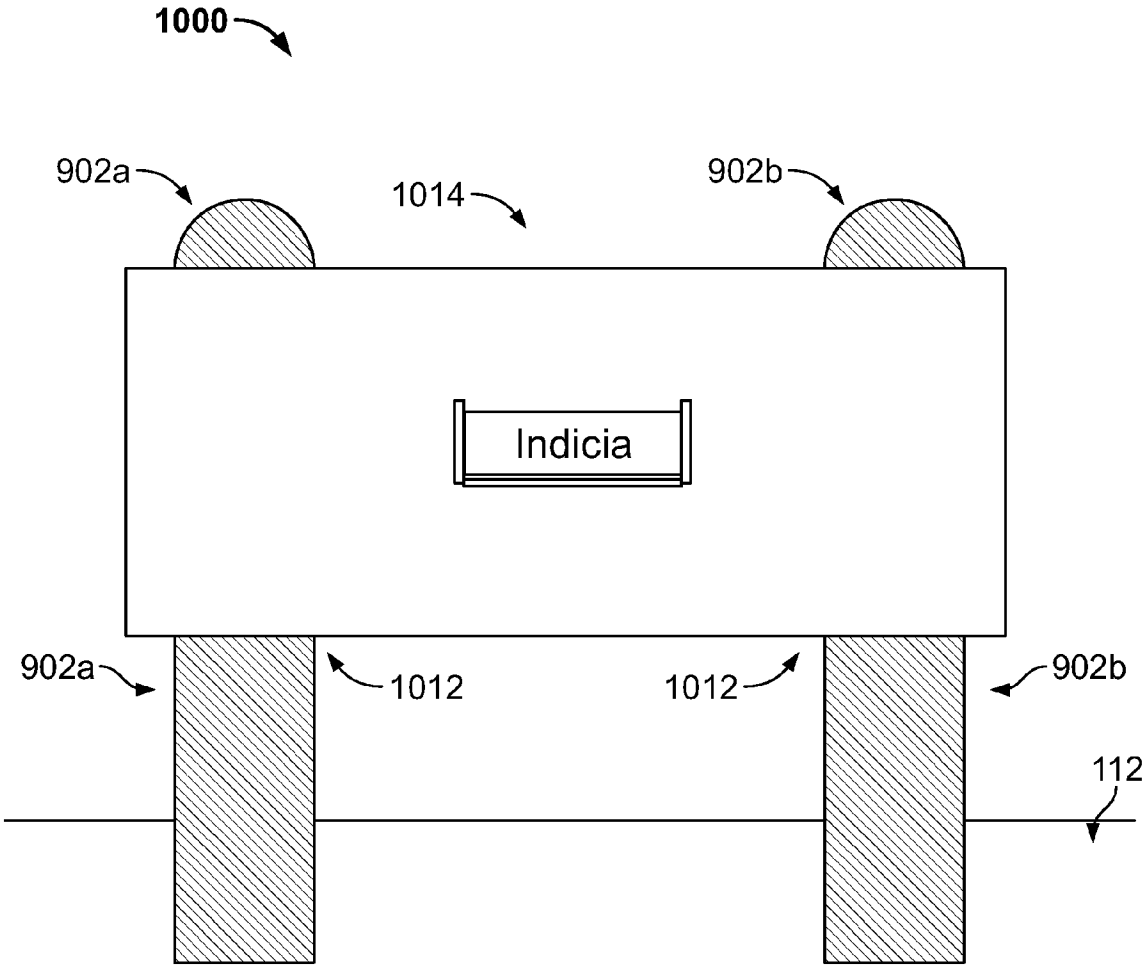
FIG. 11 is another example bollard advertising assembly coupled to multiple bollard structures.

Referring now to FIG. 11, an example bollard advertising assembly 1000 is shown.

In some example embodiments, the assembly 1000 is configured to couple to multiple bollard structures 902*a-b* (collectively, bollard structures 902). The assembly 1000 is similar in many respects to assembly 900 shown in FIG. 10. However, assembly 1000 has two open ends adjacent to an inner passage. Assembly 1000 has an open coupling end 1012 for coupling to the bollard structures 902 and an open end 1014 opposite the coupling end 1012. In some embodiments, the tops of bollard structures 902 pass through the inner passage of assembly 1000 and emerge from open end 1014.

Figures 12A, 12B, 12C, 12D:
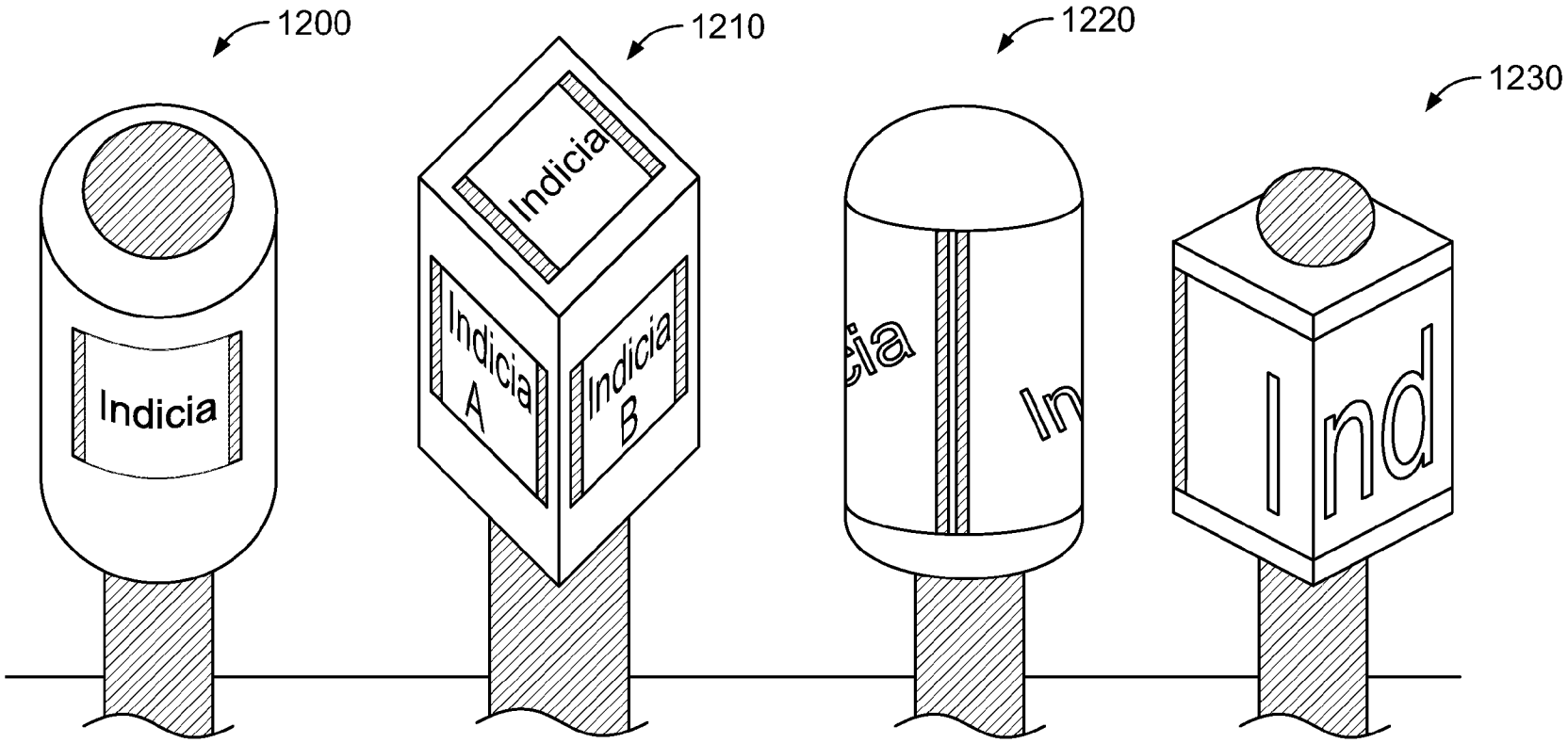
FIG. 12 shows multiple example bollard advertising assemblies coupled to bollard structures.

Referring now to FIG. 12, multiple embodiments of bollard advertising assemblies are shown.

Assembly 1200 is round in shape, has a single continuous exterior surface, and is open on two ends. The bollard structure enters the open coupling end of assembly 1200, passes through assembly 1200, and emerges from the second open end of assembly 1200. Although assembly 1200 is shown with a single advertising attachment mechanism, in other embodiments there are multiple advertising attachment mechanisms.

Assembly 1210 is rectangular in shape, has multiple discrete exterior surfaces, and is open on only one end. The bollard structure enters the open coupling end of assembly 1210 and is contained in the cavity of assembly 1210. In some embodiments, assembly 1210 includes multiple advertising attachment mechanisms. In some embodiments, these advertising attachment mechanisms hold different advertising indicia. In some embodiments, the advertising indicia may be targeted to certain events external to assembly 1210 (e.g., the time of day, the day of week, the occurrence of a sports or entertainment event, etc.). In some embodiments, assembly 1210 may be manually or automatically rotated around the bollard structure so that the appropriate advertising indicia are optimally located (e.g., facing towards where a person stands while fueling a vehicle) based on external events. Still other embodiments are possible.

Assembly 1220 is round in shape, has a single continuous exterior surface, and is open on only one end. The bollard structure enters the open coupling end of assembly 1220 and is contained in the cavity of assembly 1220. In some embodiments, assembly 1220 comprises a single advertising attachment mechanism that wraps around the entirety of the exterior surface. In other embodiments, the advertising attachment mechanism may wrap around only a portion of the exterior surface of assembly 1220. Further in some embodiments, assembly 1220 comprises multiple advertising attachment assemblies.

Assembly 1230 is rectangular in shape, has multiple discrete exterior surfaces, and is open on two ends. The bollard structure enters the open coupling end of assembly 1230, passes through assembly 1230, and emerges from the second open end of assembly 1230. In some embodiments, assembly 1230 comprises a single advertising attachment mechanism that wraps around the multiple exterior surfaces. In other embodiments, the advertising attachment mechanism may wrap around only some of the exterior surfaces of assembly 1230. Further in some embodiments, assembly 1230 comprises multiple advertising attachment assemblies.

Although FIG. 12 shows four separate embodiments of the bollard advertising assembly, other embodiments are possible, including embodiments that combine the features of some or all of the assemblies shown in FIG. 12. In addition, in some embodiments, the assembly may have a different shape than those shown in FIG. 12.

Figure 13:
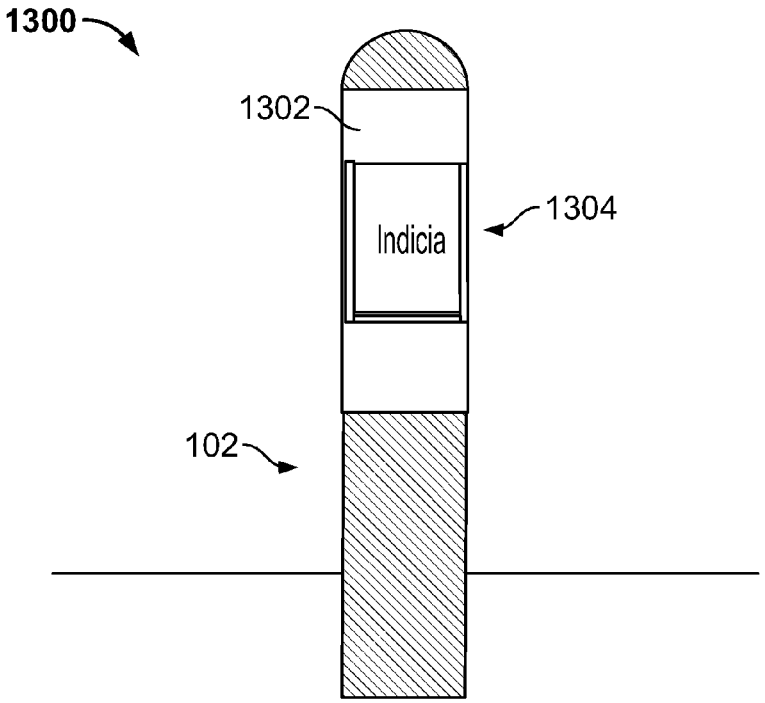
FIG. 13 is an example embodiment of a bollard advertising assembly coupled to a bollard structure.

Referring now to FIG. 13, an embodiment of a bollard advertising assembly 1300 coupled to a bollard structure 102 is shown.

Assembly 1300 includes a layer 1302 and one or more advertising attachment mechanisms 1304. In some embodiments, layer 1302 is formed of a thin, flexible material, such as foam, fabric, rubber, plastic, corrugated plastic, cardboard, metal, or paper. In some embodiments, layer 1302 is configured to wrap tightly around the bollard structure 102 and conform to the surface of bollard structure 102.

In some embodiments, advertising attachment mechanism 1304 is a clear plastic sleeve that is permanently coupled to layer 1302. In these embodiments, the advertising attachment mechanism 1304 is configured so that advertising indicia may be inserted through an opening in the top, bottom, or side of the sleeve. Further, in these embodiments, the opening in the sleeve of advertising attachment mechanism 1304 may be temporarily closed using an adhesive, clip, rubber band, or other mechanism. Still other embodiments are possible.

In some embodiments, assembly 1300 is coupled to the bollard structure 102 with Velcro, elastic bands, or friction. In other embodiments, assembly 1300 is coupled to the bollard structure 102 with straps, bolts, compression force, zip ties, springs, screw/band clamps, adhesive, tension devices, rubber, any other mechanism, or any combination thereof.

Figure 14:
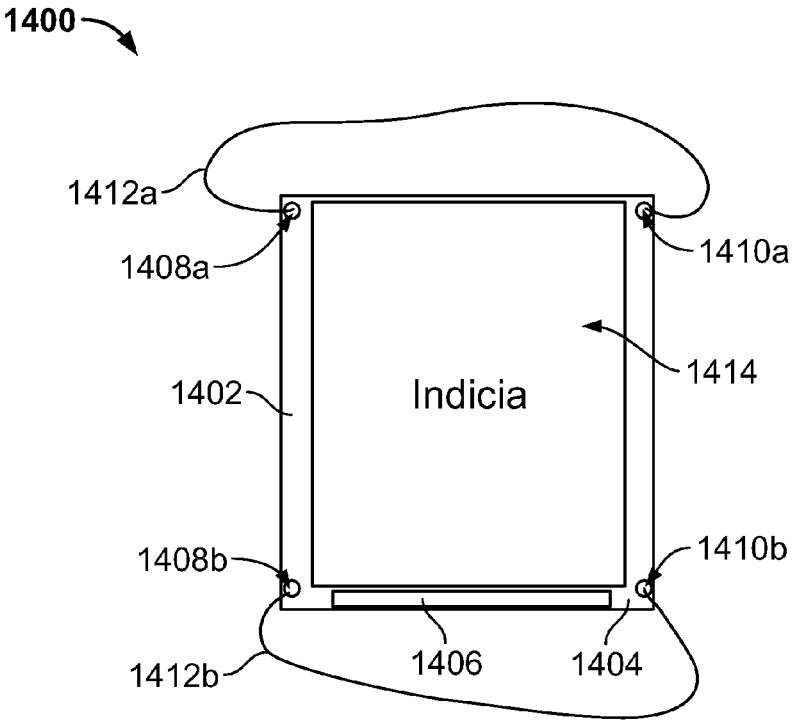
FIG. 14 is another example bollard advertising assembly.

Referring now to FIG. 14, an example embodiment of a bollard advertising assembly 1400 is shown.

Assembly 1400 includes a sleeve 1402 and one or more coupling mechanisms 1412*a-b* (collectively, coupling mechanisms 1412).

Sleeve 1402 is configured to hold an advertising indicia 1414 and includes an opening 1404, and a closure mechanism 1406. In some embodiments, sleeve 1402 is formed of multiple sheets of clear, flexible plastic that are joined on multiple edges. Sleeve 1402 is configured so that advertising indicia 1414 may be inserted through opening 1404. Although, the opening 1404 is disposed along the bottom edge of sleeve 1402 in FIG. 14, other embodiments are possible. For example, opening 1404 may be disposed along a side or top of sleeve 1402. Yet in other embodiments, opening 1404 is disposed on the front or back surface of sleeve 1402 at a location between the top and bottom of sleeve 1402.

Closure mechanism 1406 is configured to seal opening 1404 after the advertising indicia is inserted. In some embodiments, closure mechanism 1406 is configured to permanently seal opening 1404. In other embodiments, closure mechanism 1406 is configured to temporarily seal opening 1404. In some embodiments, closure mechanism 1406 may be reusable, while in other embodiments closure mechanism 1406 may be used only once. In some embodiments, closure mechanism 1406 is a permanent or temporary adhesive, clip, rubber band, or other mechanism. Still other embodiments are possible.

Sleeve 1402 is coupled to a bollard structure with coupling mechanisms 1412. Coupling mechanisms 1412 are secured to a first side of sleeve 1402 at attachment points 1408*a-b* and a second side of sleeve 1402 at attachment points 1410*a-b*. In some embodiments, coupling mechanisms 1412 comprise elastic bands, rubber bands, strings, zip ties, or screw/band clamps. Other embodiments are possible.

In some embodiments, the attachment points 1408*a-b* and 1410*a-b* are holes. In other embodiments, the attachment points 1408*a-b* and 1410*a-b* are bolts, knobs, buttons, clasps, screws, clips, or adhesives. Still other embodiments are possible. Although the embodiment shown in FIG. 15 includes four attachment points, other embodiments with more or fewer attachment points are possible.

Figure 15:
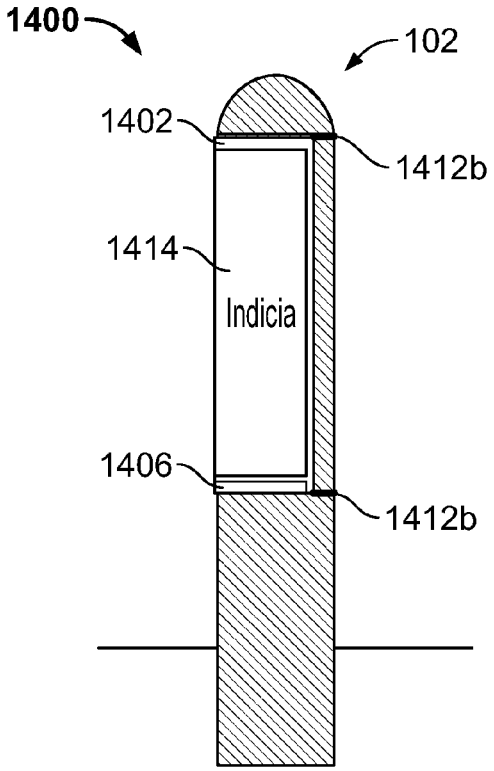
FIG. 15 is the bollard advertising assembly of FIG. 14 coupled to a bollard structure.

Referring now to FIG. 15, bollard advertising assembly 1400 is shown coupled to bollard structure 102.

Coupling mechanisms 1412 wrap around bollard structure 102 to couple sleeve 1402 to the bollard structure 102. Sleeve 1402 conforms to the surface of bollard structure 102. Sleeve 1402 contains advertising indicia 1414. Advertising indicia 1414 is secured in sleeve 1402 by closure mechanism 1406, which prevents advertising indicia 1414 from sliding out of the bottom of sleeve 1402. In some embodiments, the opening to sleeve 1402 is oriented towards the ground so that rain and snow are unlikely to fall into sleeve 1402 and damage advertising indicia 1414. In other embodiments, other orientations are used.

Figure 16:
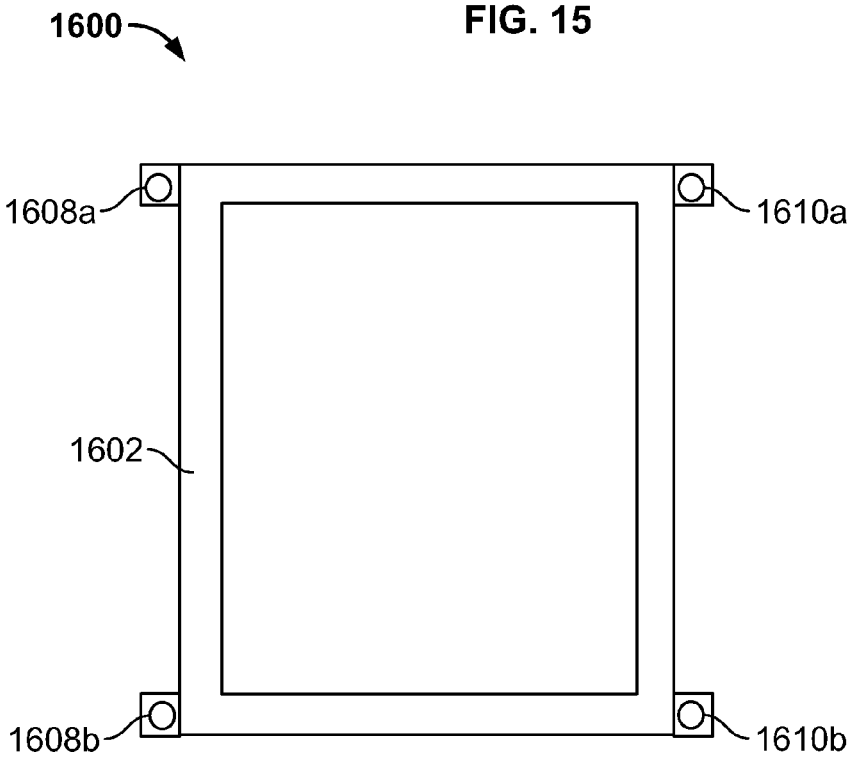
FIG. 16 is a front view of another example bollard advertising assembly.

Referring now to FIG. 16, a front view of another example bollard advertising assembly 1600 is shown.

Assembly 1600 includes a frame 1602 and one or more attachment points 1608*a-b* and 1610*a-b*.

Frame 1602 is configured to hold various advertising indicia and couple to a bollard structure. In some embodiments, frame 1602 is formed from a flexible material. In some embodiments, frame 1602 is formed from foam, fabric, rubber, plastic, corrugated plastic, cardboard, metal, or paper. Additionally, in some embodiments, frame 1602 includes a transparent protective cover, which is configured to protect the advertising indicia. In some embodiments, frame 1602 conforms to the shape of the bollard structure Attachment points 1608*a-b* and 1610*a-b* are configured to attach to a mechanism to couple assembly 1600 to a bollard structure. For example, in some embodiments assembly 1600 is configured to couple to a bollard structure with a bungee cord. In some of these embodiments, attachment points 1608*a-b* and 1610*a-b* are holes, which are configured to couple with the hooks at the ends of the bungee cords. In other embodiments, assembly 1600 is configured to be coupled to a bollard structure with elastic bands, rubber bands, strings, zip ties, or screw/band clamps. Accordingly, in other embodiments, attachment points 1608*a-b* and 1610*a-b* are bolts, knobs, buttons, clasps, screws, clips, or adhesives. Still other embodiments are possible.

Figure 17:
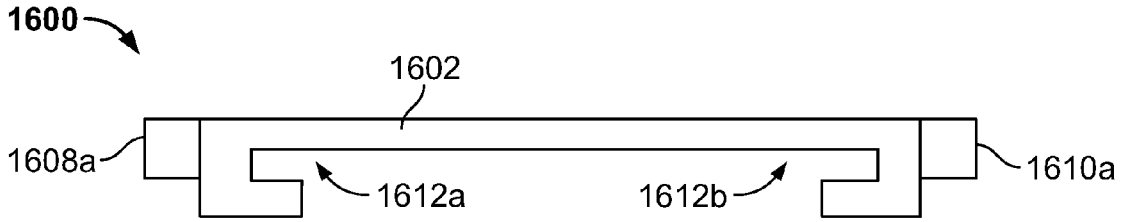
FIG. 17 is a top view of the bollard advertising assembly of FIG. 16.

Referring now to FIG. 17, a top view of bollard advertising assembly 1600 is shown.

Frame 1602 includes channels 1612*a-b* (collectively channels 1612). Channels 1612 are configured to couple to advertising indicia. In some embodiments, the advertising indicia may be slid into channels 1612 from the top of frame 1602. In other embodiments, other orientations are used. In some embodiments, channels 1612 run from the top of frame 1602 to the bottom of frame 1602. In other embodiments, channels 1612 run only partially from the top of frame 1602 to the bottom of frame 1602. In yet other embodiments, multiple channels are aligned along the edges of frame 1602 and run from the top of frame 1602 to the bottom of frame 1602.

Figure 18:
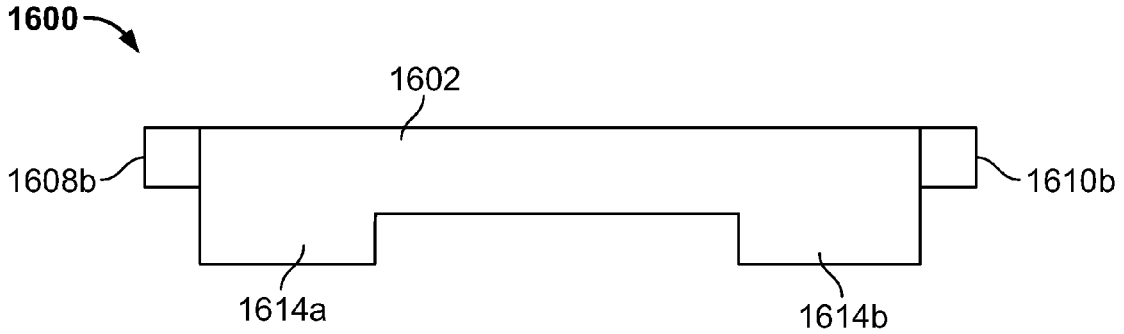
FIG. 18 is a bottom view of the bollard advertising assembly of FIG. 16.
Figure 19:
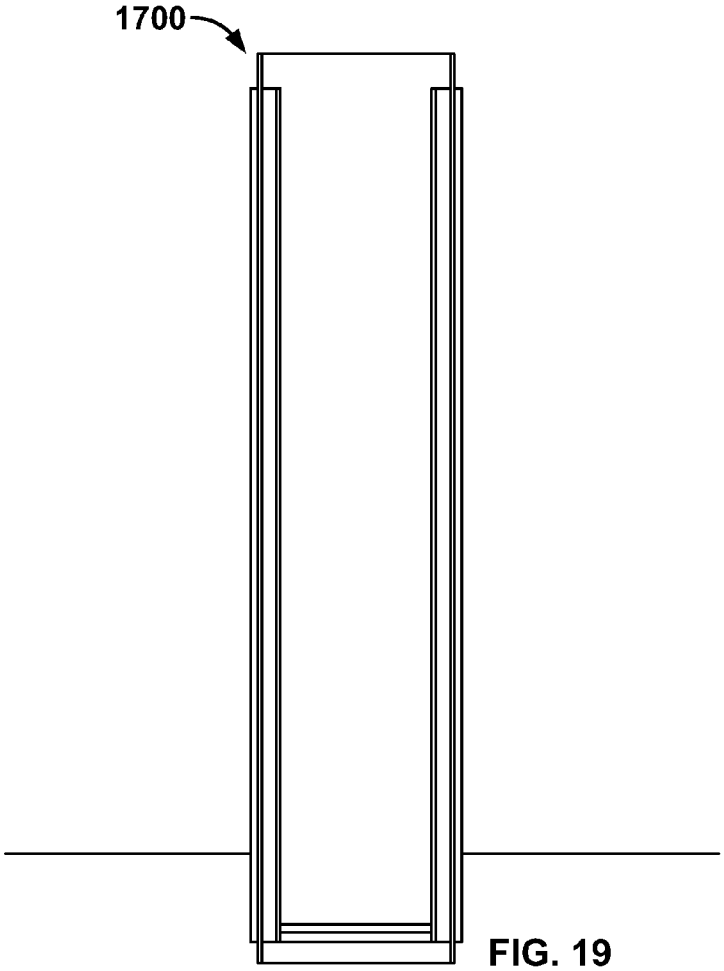
FIGS. 19-30 show additional example bollard advertising assemblies.
Figure 20:
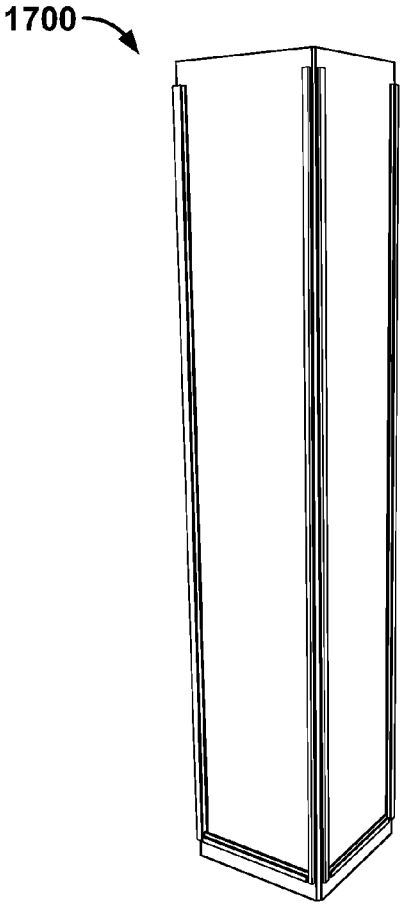

Referring now to FIG. 18, a bottom view of bollard advertising assembly 1600 is shown.

Frame 1602 includes stoppers 1614*a-b*. Stoppers 1614*a-b* are configured to stop advertising indicia from sliding out of the bottom of frame 1602. In some embodiments, stoppers 1614*a-b* are horizontally oriented shelves. In other embodiments, stoppers 1614*a-b* are knobs, bolts, ridges, or bumps. Other embodiments are possible. Although two stoppers are shown in FIG. 18, other embodiments with more or fewer stoppers are possible.

Referring now to FIGS. 19-30, see the images therein for additional details of example embodiments of the bollard advertising assembly.

In FIGS. 19-27, a bollard advertising assembly 1700 is shown. The bollard advertising assembly 1700 includes a square cross section (although other configurations, such as round shapes can be used) including an outer surface with channels coupled thereto. The channels are sized to receive advertisements that can be inserted into and out of the channels.

Figure 21:
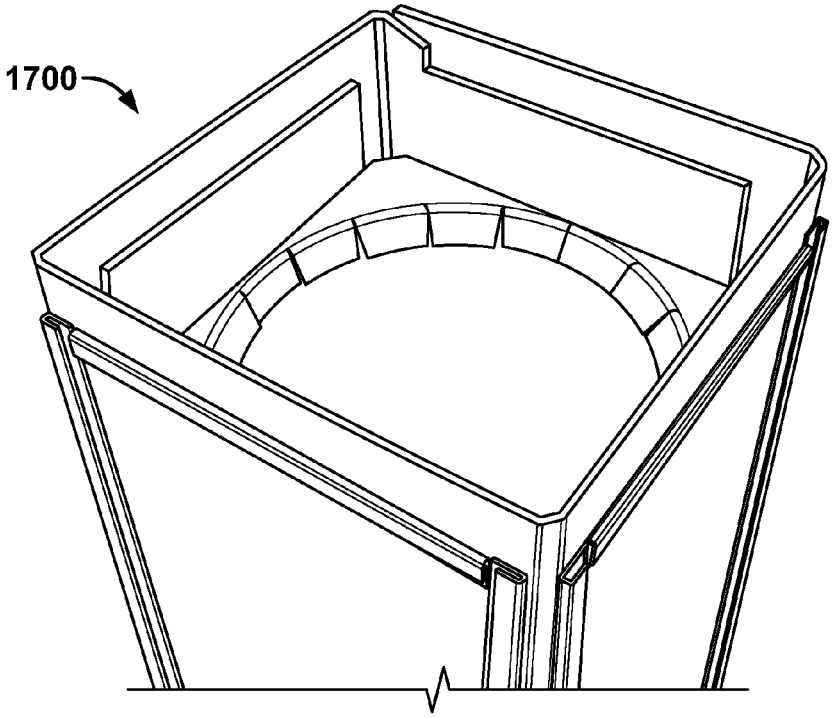
Figure 22:
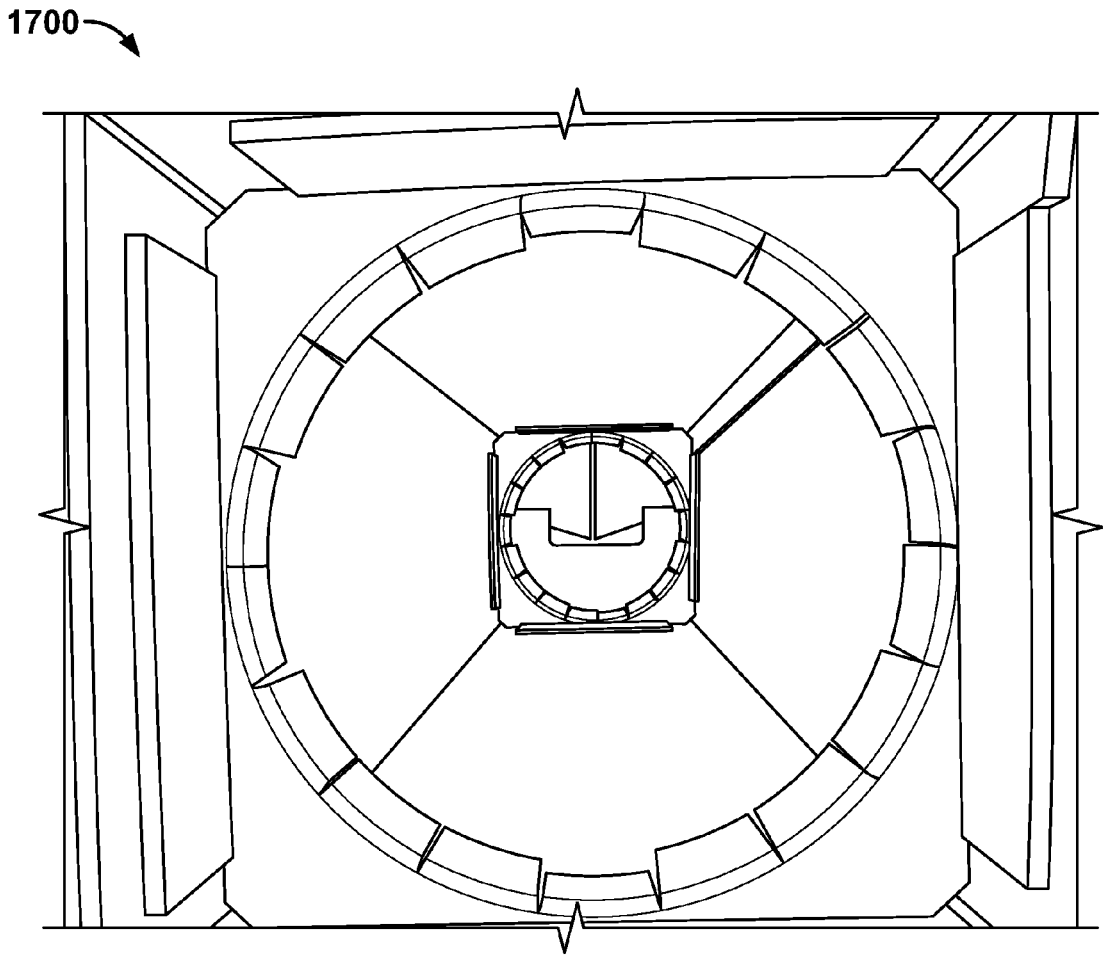
Figure 23:
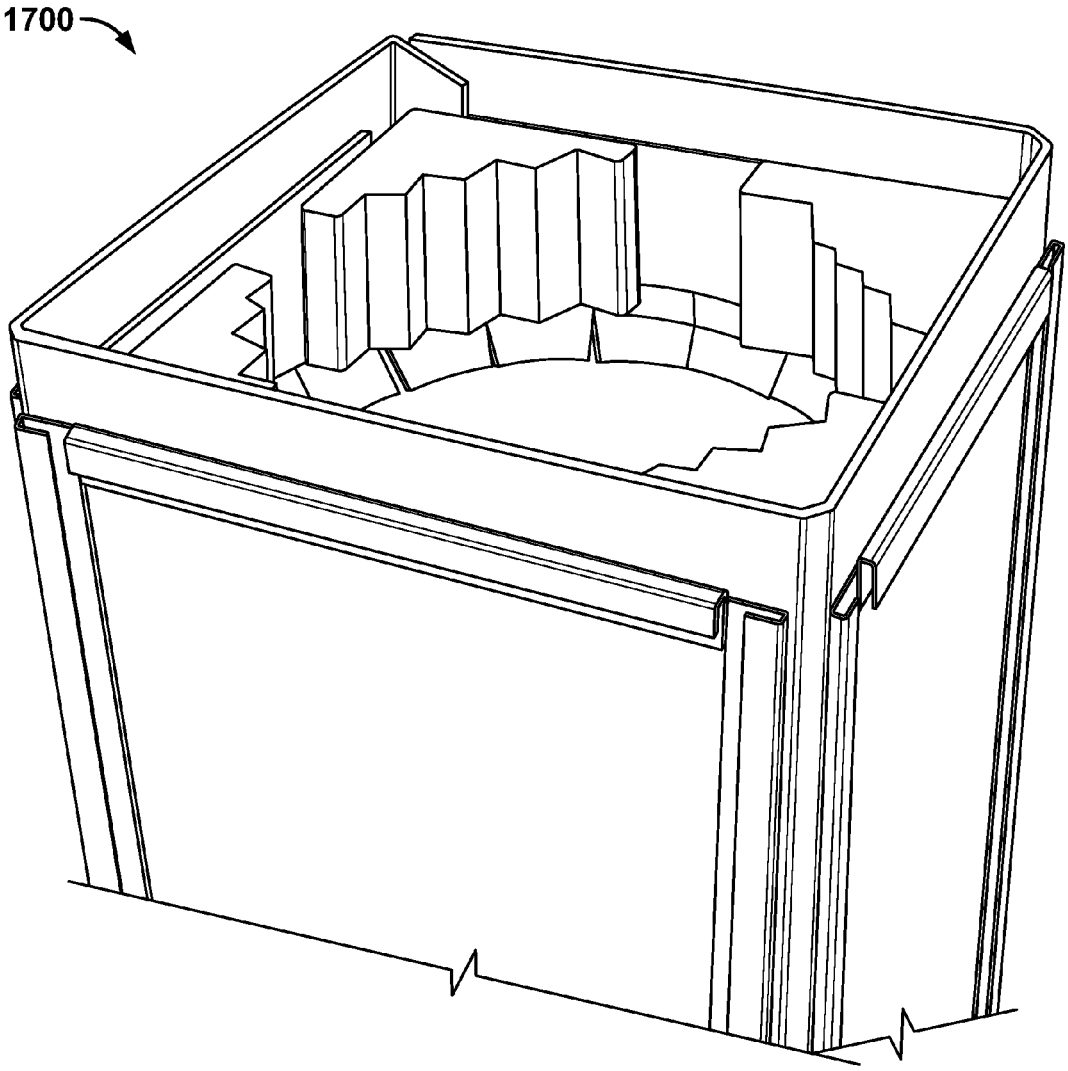
Figure 24:
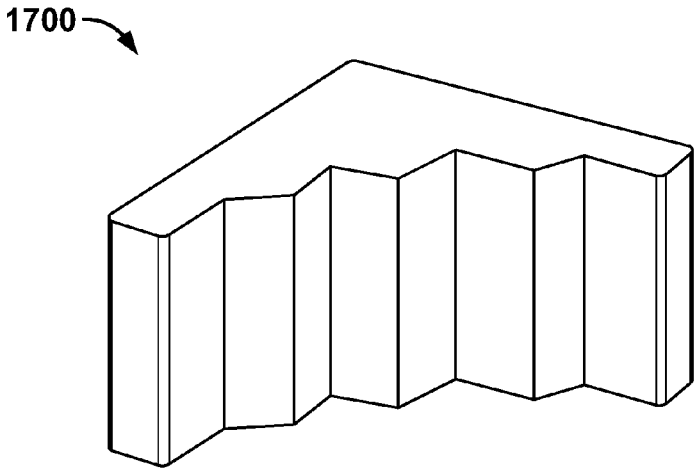
Figure 25:
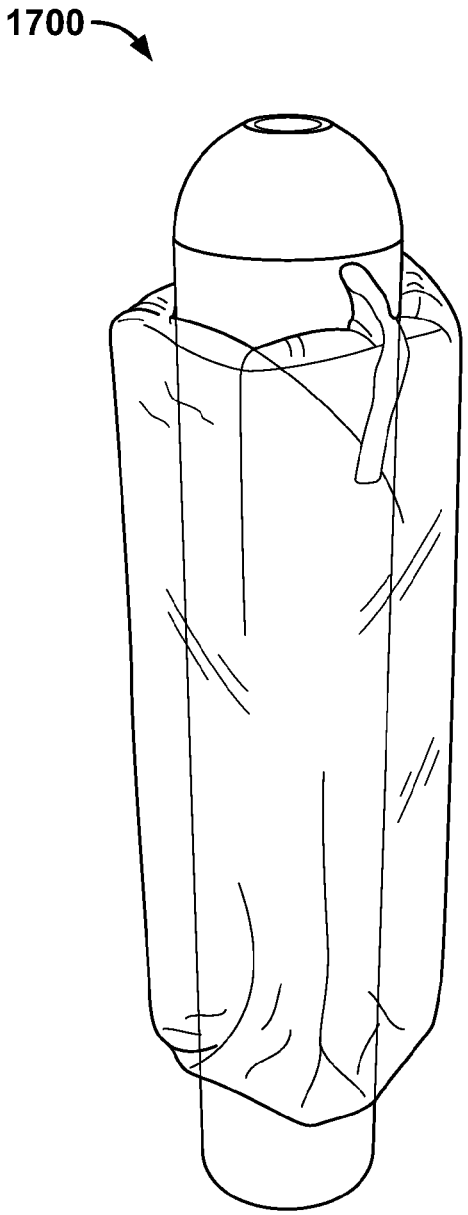
Figure 26:
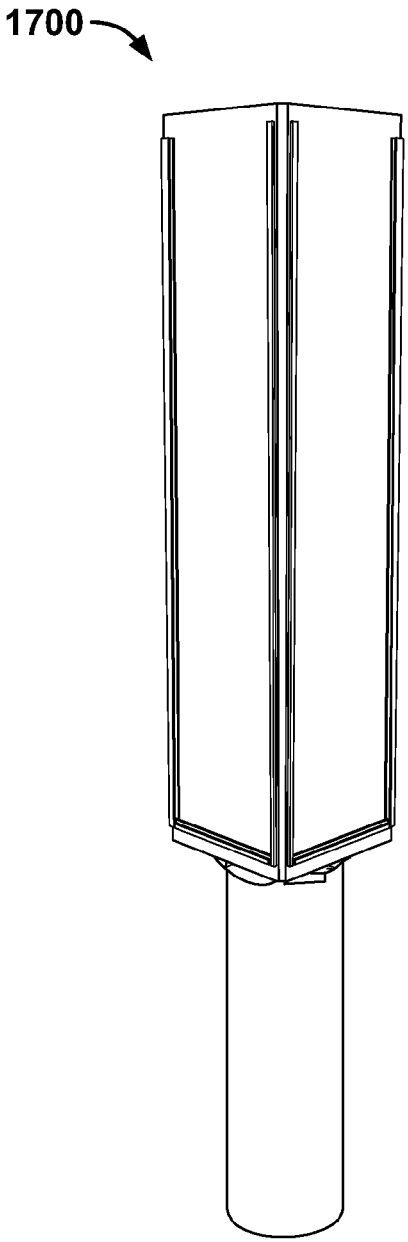
Figure 27:
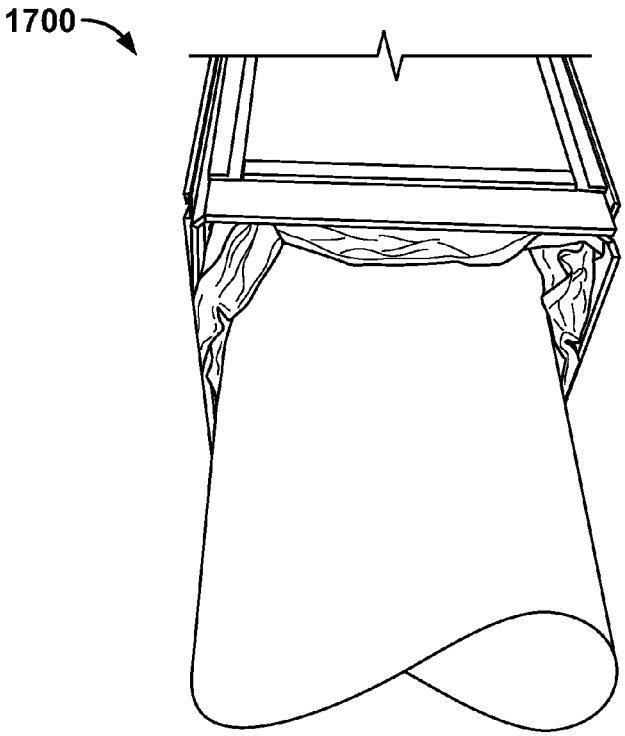

As shown in FIGS. 21-22, an interior of the bollard advertising assembly 1700 includes an insert sized to accept a bollard. In addition, as shown in FIGS. 23-24, compressible inserts (similar to the compressible inserts 706*a* shown in FIG. 8) having a stepped configuration can be used to further engage the bollard as the bollard advertising assembly 1700 is inserted thereon. In some embodiments, an inflatable membrane as shown in FIGS. 25-27 can also be used to couple the bollard advertising assembly 1700 to the bollard. For example, the inflatable member can be positioned on the bollard, and the bollard advertising assembly 1700 can be positioned onto the inflatable member. The inflatable member can thereupon be further inflated to couple the bollard advertising assembly 1700 to the bollard. Other configurations are possible.

Figure 28:
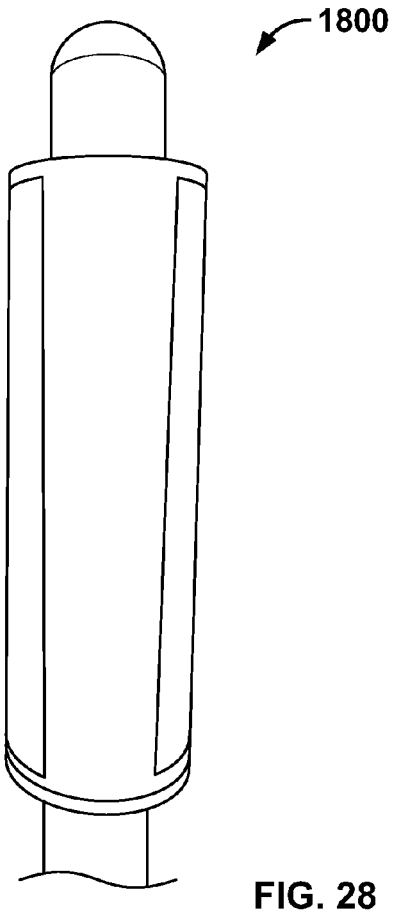
Figure 29:
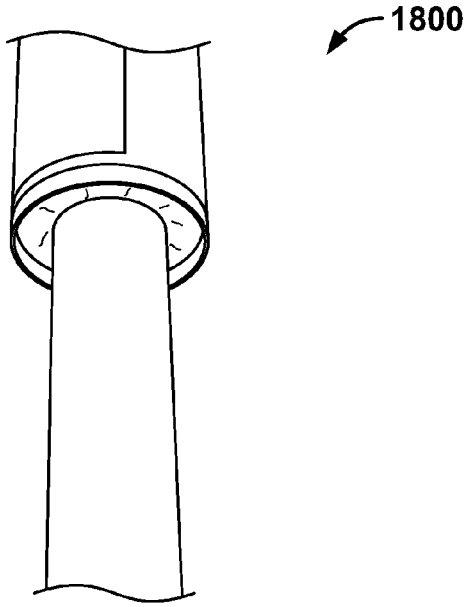
Figure 30:
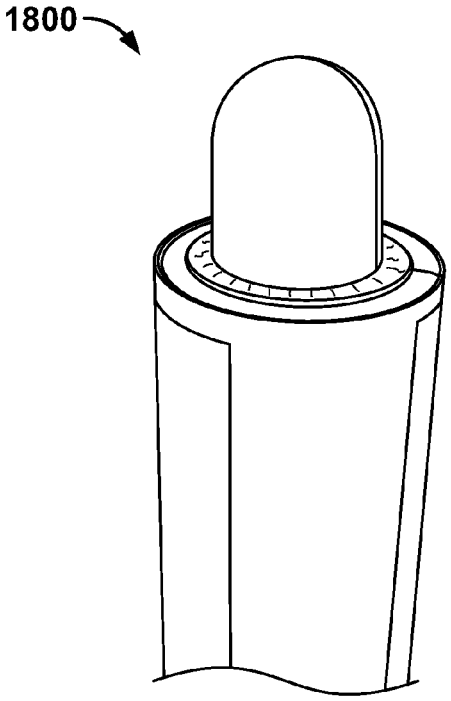

As shown in FIGS. 28-30, another example bollard advertising assembly 1800 is shown. The bollard advertising assembly 1800 includes a foam interior sized to engage the bollard as the bollard advertising assembly 1800 is inserted onto the bollard. In addition, the bollard advertising assembly 1800 includes an outer sleeve with one or more pockets. The pockets are sized to receive advertisements positioned therein.

In some examples, such as in the bollard advertising assembly 1800, the advertisements displayed by the bollard advertising assembly 1800 can be configured to be changed periodically, either using an automated or manual process. For example, the bollard advertising assembly 1800 can be configured such that two or more advertisements can be displayed, and the user can decided which advertisement to display at a given time. If a different advertisement is desired (for example, depending on the time of day, different advertisements can be displayed, such as advertisements for breakfast items in the morning and dinner items in the afternoon), the user can manually switch the advertisement, such as by rotating the advertisements. For example, the user can rotate an outer sleeve that covers the second advertisement so that the second advertisement is visible and the first advertisement is hidden in one example.

In other examples, the advertisements can be configured to automatically change depending on variables such as time of day, day of week, etc. For example, an electric motor can be used to cycle through advertisements depending on the variables described herein.

In another alternative, mechanisms for coupling one or more advertisements to the bollard are molded directly to the bollard during or after manufacture of the bollard. For example, during manufacture of the bollard, one or more coupling mechanism can be coupled to the bollard. One such example is one or more sleeves or channels that are molded (e.g., rotational molded, blow molded, injection molded, compression molded, or other techniques such as three dimensional printing) onto the bollard during manufacture of the bollard. When the bollard is positioned by the end user, advertisements can be introduced into the mechanisms that are incorporated as part of the bollard.

In another example, an advertisement can be printed on a semi-rigid material, such as styrene or colorplast. The material can thereupon be shaped and coupled to a bollard using techniques such as adhesives (permanent or releasable) or other attachment mechanisms such as straps, etc. Other configurations are possible.

The above disclosure is directed to a bollard advertising assembly constructed to protect a bollard structure from damage incurred from various surface and structural degrading phenomena, and include one or more advertising indicia to increase the visibility of the bollard structure and convey messages. However, the advertisement assembly is not limited to applications involving bollards. Additionally, the bollard advertising assembly is not limited to the securing mechanisms disclosed herein. For example, in some embodiments, the bollard advertising assembly may be secured to the bollard structure with straps, bolts, compression force, zip ties, springs, screw/band clamps, adhesive, tension devices, elastic, rubber, any other mechanism, or any combination thereof. In general, the disclosed advertising assembly can be used for advertising with any structure or apparatus. For example, the disclosed advertising assembly can be used for advertising with gas pumps, street signs, light posts, bicycle racks, parking meters, parking garage or other structural columns, and many others applications.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An advertising bollard assembly, comprising:

a main body defining an interior and an outer surface;

four compressible inserts positioned at corners formed by the interior of the main body, the compressible inserts being configured to be positioned on a bollard to couple the advertising bollard assembly to the bollard; and an attachment mechanism coupled to the outer surface of the main body, the attachment mechanism being configured to receive one or more advertisements.

2. The advertising bollard assembly of claim 1, wherein the compressible inserts are stepped.

3. The advertising bollard assembly of claim 1, wherein the attachment mechanism is a channel.

4. The advertising bollard assembly of claim 3, wherein the channel is formed by one or more J-hooks.

5. The advertising bollard assembly of claim 4, wherein the J-hooks form a frame for the advertisements.

6. A bollard system, comprising:

a bollard; and an advertising bollard assembly, including:

a main body defining an interior and an outer surface;

four compressible inserts positioned at corners formed by the interior of the main body, the compressible inserts being configured to be positioned on the bollard to couple the advertising bollard assembly to the bollard; and an attachment mechanism coupled to the outer surface of the main body, the attachment mechanism being configured to receive one or more advertisements.

7. The bollard system of claim 6, wherein the compressible inserts are stepped.

8. The bollard system of claim 6, wherein the attachment mechanism is a channel.

9. The bollard system of claim 8, wherein the channel is formed by one or more J-hooks.

10. The bollard system of claim 9, wherein the J-hooks form a frame for the advertisements.

11. A method of forming an advertising bollard assembly, the method comprising:

forming a main body defining an interior and an outer surface;

positioning four compressible inserts at corners formed by the interior of the main body, the compressible inserts being configured to be positioned on the bollard to couple the advertising bollard assembly to the bollard;

coupling a frame to the main body, the frame including space for one or more advertisements to be inserted therein; and positioning the advertisements in the frame.

12. The method of claim 11, further comprising forming the frame to include a channel.

* * * * *